US010255831B1

(12) United States Patent
Buck

(10) Patent No.: US 10,255,831 B1
(45) Date of Patent: Apr. 9, 2019

(54) LIGHT TILE ASSEMBLY AND KIT

(71) Applicant: Ronald Mark Buck, Encinitas, CA (US)

(72) Inventor: Ronald Mark Buck, Encinitas, CA (US)

( * ) Notice: Subject to any disclaimer, the term of this patent is extended or adjusted under 35 U.S.C. 154(b) by 0 days.

(21) Appl. No.: 16/191,643

(22) Filed: Nov. 15, 2018

(51) Int. Cl.

| | |
|---|---|
| ***F21V 7/04*** | (2006.01) |
| ***G09F 13/04*** | (2006.01) |
| ***A47G 1/06*** | (2006.01) |
| ***G09F 13/22*** | (2006.01) |
| ***F21V 33/00*** | (2006.01) |
| ***G09F 13/10*** | (2006.01) |

(52) U.S. Cl.
CPC ..... *G09F 13/0413* (2013.01); *A47G 1/065* (2013.01); *A47G 1/0638* (2013.01); *F21V 33/0032* (2013.01); *G09F 13/10* (2013.01); *G09F 13/22* (2013.01); *A47G 2001/0672* (2013.01); *G09F 2013/0445* (2013.01); *G09F 2013/222* (2013.01)

(58) Field of Classification Search
CPC ..... A47G 1/0638; A47G 1/065; A47G 2001/0672; F21V 33/0032; G09F 13/0413; G09F 13/10; G09F 13/22; G09F 2013/0445; G09F 2013/222
USPC ..... 362/600–605, 612, 632–634
See application file for complete search history.

(56) References Cited

U.S. PATENT DOCUMENTS

| | | | |
|---|---|---|---|
| 1,348,957 | A | 8/1920 | Pope |
| 2,529,713 | A | 11/1950 | Thurston |
| 2,677,909 | A | 5/1954 | Heydenryk |
| 3,318,032 | A | 5/1967 | Robison et al. |
| 4,819,353 | A | 4/1989 | Glucksman et al. |
| 4,942,685 | A | 7/1990 | Lin |
| 5,003,715 | A | 4/1991 | Steiner |
| 5,247,745 | A | 9/1993 | Valentino |
| 5,371,656 | A | 12/1994 | Iorfida |
| 5,412,887 | A | 5/1995 | Layne |
| 5,533,289 | A | 7/1996 | Hoffman |
| 5,657,563 | A | 8/1997 | Lane |
| 6,591,530 | B1 | 7/2003 | Liao |
| 6,672,748 | B2 | 1/2004 | Baldwin |
| 7,107,712 | B2 | 9/2006 | Mueller |
| 7,186,015 | B2 | 3/2007 | Kimmer et al. |
| 7,281,834 | B2 | 10/2007 | Sinofsky |

(Continued)

FOREIGN PATENT DOCUMENTS

| | | |
|---|---|---|
| WO | 2002061334 | 8/2002 |

*Primary Examiner* — Jason M Han
(74) *Attorney, Agent, or Firm* — Manuel de la Cerra

(57) ABSTRACT

A low-profile light tile assembly that employs a self-adhesive, removable/exchangeable photograph or artwork overlay. The light tile provides frameless edge-to-edge illumination that may be illuminated by a single LED light strip. The light tile may hang on a wall, or used as a countertop display. When mounted on a wall, the assembly uses a male/female magnet-based mating system that offers dial-in leveling. The light tile image also looks vibrant and beautiful when the light tile is not illuminated. The light tile may be programmed or turned on or off via a wireless remote control. An ultra-thin rechargeable battery maintains the tiles low-profile. When used as a countertop display, the light tile may use a USB cord to plug into a wall socket. The light tile assembly may come in a kit that includes a folding countertop display stand, a battery charging station, and an optional front-surface-mounting picture frame.

27 Claims, 14 Drawing Sheets

(56) References Cited

U.S. PATENT DOCUMENTS

| | | | |
|---|---|---|---|
| 7,883,252 | B2 | 2/2011 | Matsui et al. |
| 7,942,542 | B1 | 5/2011 | Dunn |
| 9,375,103 | B1 | 6/2016 | Hoppaugh et al. |
| 2002/0040541 | A1 | 4/2002 | Wang |
| 2002/0187365 | A1 | 12/2002 | Fowlkes et al. |
| 2005/0117330 | A1 | 6/2005 | Chen |
| 2005/0239581 | A1 | 10/2005 | Naylor et al. |
| 2006/0285358 | A1 | 12/2006 | Chen et al. |
| 2008/0034633 | A1 | 2/2008 | Tang |
| 2010/0088941 | A1 | 4/2010 | Zhu |
| 2011/0051399 | A1 | 3/2011 | Hickey |
| 2014/0223787 | A1 | 8/2014 | Richmond et al. |
| 2018/0080274 | A1 | 3/2018 | Darnes |

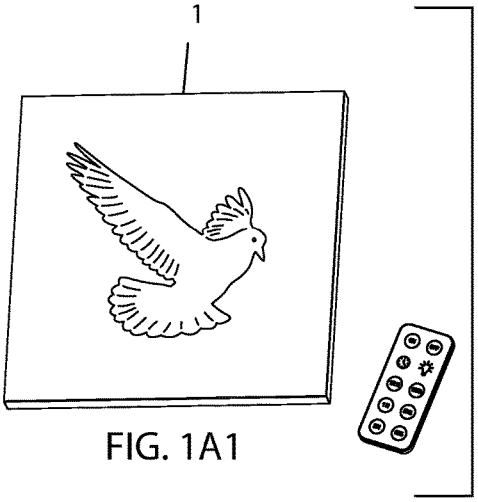
FIG. 1A1
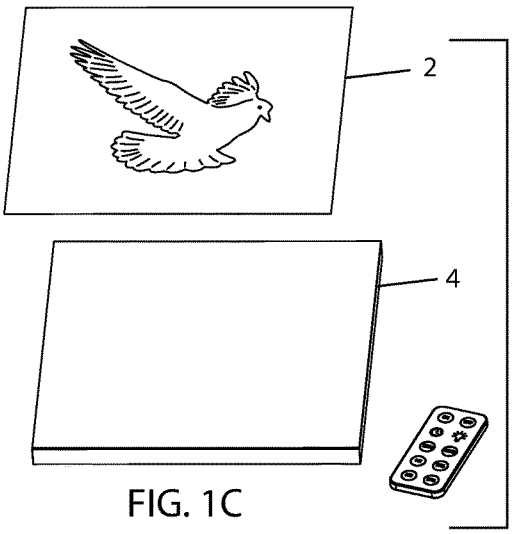
FIG. 1C
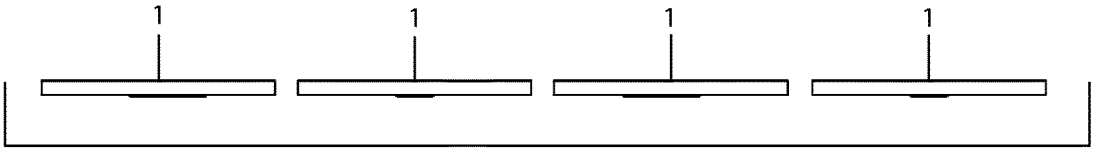
FIG. 1D
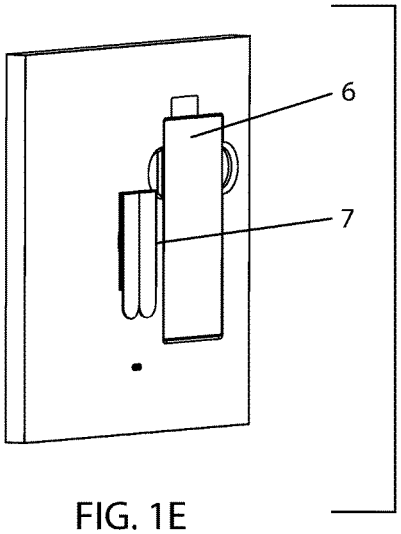
FIG. 1E
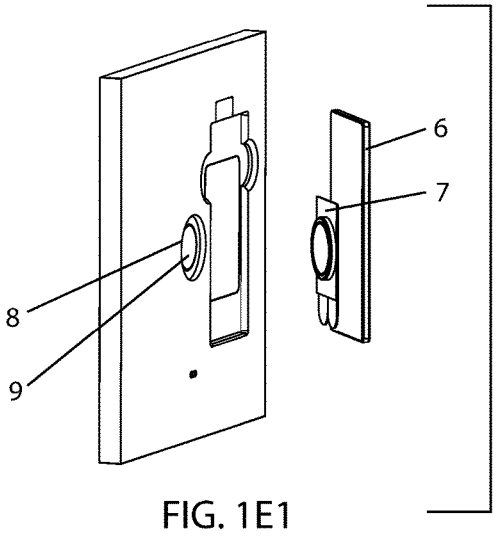
FIG. 1E1

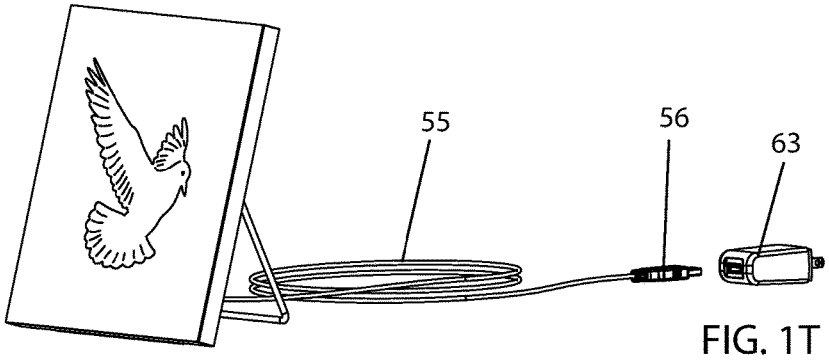
FIG. 1T
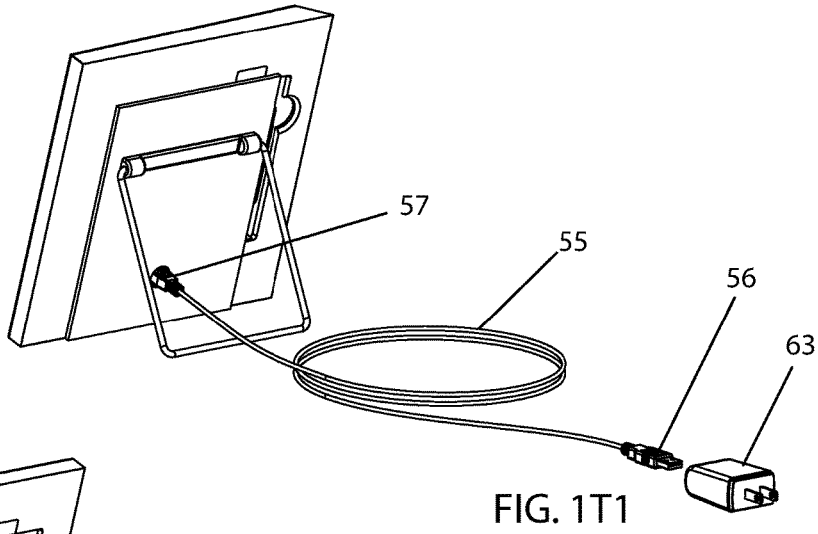
FIG. 1T1
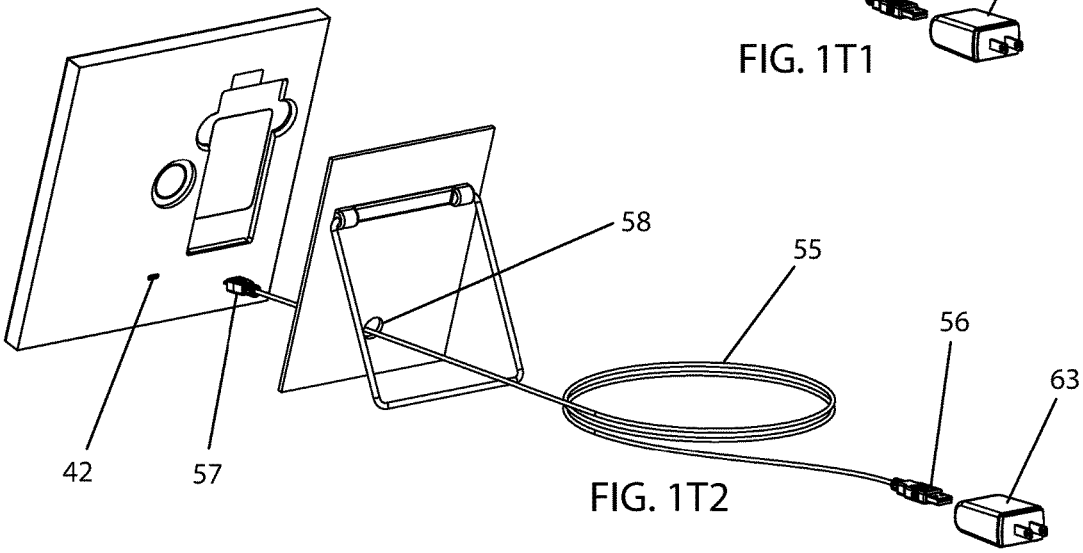
FIG. 1T2

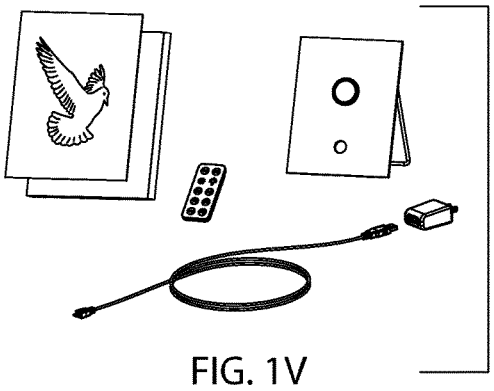
FIG. 1V
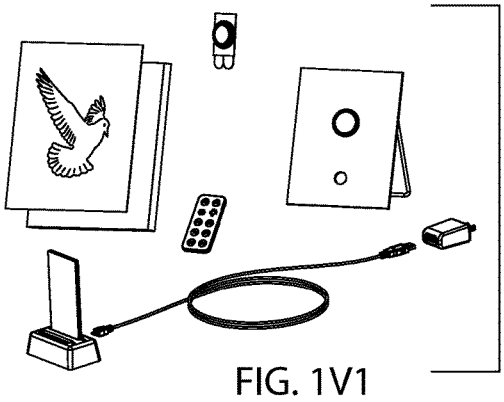
FIG. 1V1
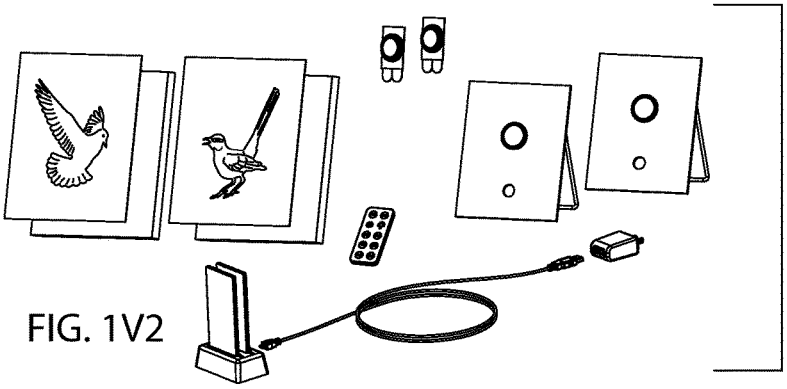
FIG. 1V2
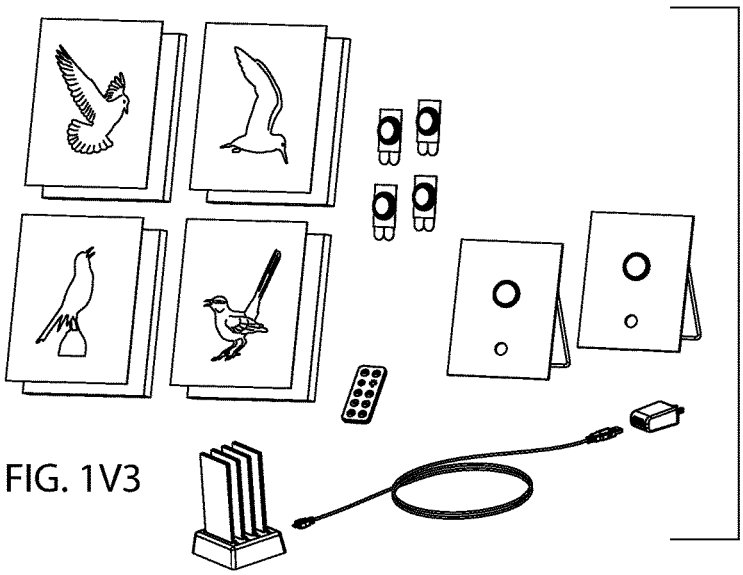
FIG. 1V3

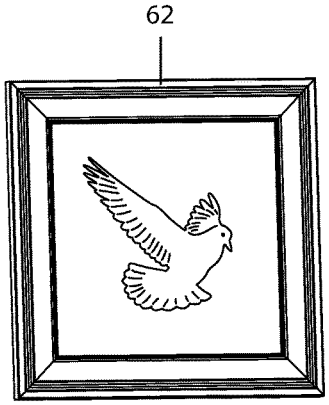
FIG. 1W
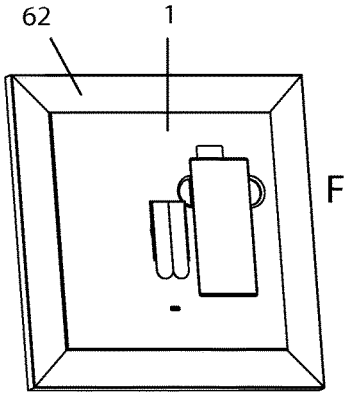
FIG. 1W1
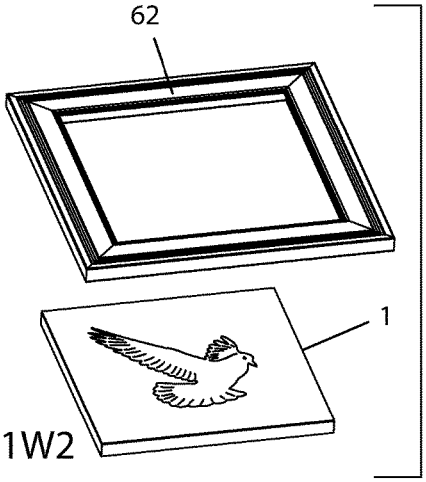
FIG. 1W2
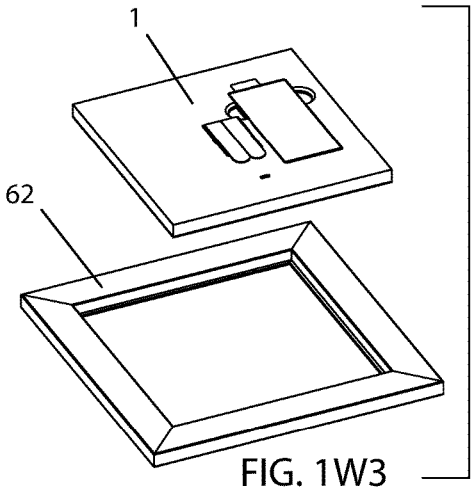
FIG. 1W3
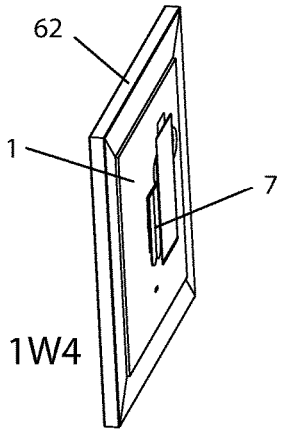
FIG. 1W4
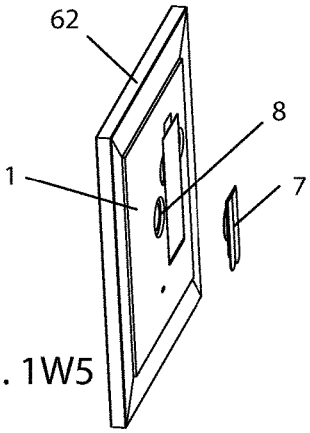
FIG. 1W5

LIGHT TILE ASSEMBLY AND KIT

TECHNICAL FIELD

The present invention is related to light panels to illuminate art and photographs.

BACKGROUND

An illuminated picture frame, or edge-lit backlighting panel, is not new. Edge-lit backlighting panels are often utilized in consumer electronic products. Illuminated picture frames have been previously contemplated and invented; however many of the prior embodiments comprise complex frame structures, bulky or nonintegrated battery attachments, and antiquated mounting mechanisms.

For example, U.S. Pat. No. 4,819,353, issued to Gluckman, Cohen, and Ratzlaff, discloses an illuminated picture frame that comprises an outer frame structure with an interior matte, wherein the frame structure and matte are utilized to block or conceal the light source that illuminates the assembly. Because the frame structure and matte are located at the exterior edges of the main body, this type of construction will not allow edge-to-edge illumination as described below in the present invention. Additionally, the batteries for the '353 Patent are located within a battery housing that is built into the support leg that mounts to the back wall of the assembly. Because the support leg extends outwardly from the back wall of the main body, the total assembly is too cumbersome and bulky to mount to a wall in a low profile; therefore the '353 Patent is limited and may only be utilized as a table or countertop display.

Likewise, U.S. Pat. Pub. No. 20100088941 by Shiqi Zhu also discloses an illuminated picture frame that comprises an outer frame structure that is configured to block or conceal the light source, or LED strip, that illuminates the assembly. However, like the previous prior art, a construction that employs a frame structure at the exterior edges of the main body will not allow edge-to-edge illumination as described below in the present invention. Additionally, the batteries of the '941 Publication are built into a rear-mounted display stand battery housing, so again the total construction is too bulky to mount on a wall in a low profile; therefore, the invention is limited and may only be utilized as a table or countertop display.

U.S. Pat. No. 5,657,563 by Lane, and U.S. Pat. No. 7,942,542 by Dunn, also disclose illuminated picture frame embodiments that employ outer frame structures to block or conceal the primary light sources, and batteries that are built into auxiliary assemblies that prevent flat wall mounting and limit the inventions to table or countertop applications. For example, the '563 Patent incorporates the batteries into the display stand assembly that mounts to the back wall of the main body; and the '542 Patent positions the batteries in the bottom of a condiment, straw, or napkin holder.

Finally, U.S. Pat. Pub. No. 20060285358 by Chen and Shen, and U.S. Pat. Pub. No. 20140223787 by Richmond and Pesek, disclose illuminated picture frames that employ one or more LED light strips and an outer frame structure to block or conceal the light source origin points. These two references do not to employ a thick, translucent, milky-white diffusion layer, as described below in the present invention. The '358 and '787 Publications rely on the strategic placement of an outer frame structure to block or conceal LED "hotposts". Additionally, these references offer no wall mounting option, although the '787 Publication does disclose a front surface adhesive mounting system, wherein the front surface of the assembly mounts to a window, and the image or artwork is viewed through the window.

Recent advancements in the development of more efficient and smaller light-emitting diodes (LEDs), and thinner and more compact Lithium-ion batteries warrant a new approach to developing a thin, frameless (edge-to-edge illuminated), elegant lighting assembly that draws less power, while additionally providing a means for employing a removable/exchangeable photograph or artwork overlay.

Constructing a thin, power-efficient lighting assembly with edge-to-edge illumination is a difficult task. One big design challenge that arises while constructing a thin frameless lighting configuration is how to avoid "hotspots" that occur along the linear edge where the LEDs shine into the light guide panel. Another challenge is providing a low profile design that can be mounted to a wall with quick and easy removal of the ultra-thin rechargeable battery from the backside of the assembly.

There are two main ways to backlight a photo or artwork lighting display. The first way is to mount an array of LEDs in even rows on the bottom layer of the lighting assembly, then a uniform air-gap is provided above the LEDs to diffuse the "hotspots" where the LEDs are located; and finally, an additional diffusion layer may be oriented above the uniform air-gap to further diffuse the areas where the "hotspots" are located. This type of configuration requires an air-gap that increases the thickness of the lighting assembly. Light boxes typically use this type of lighting construction that employs a uniform air-gap. This design sufferes from at least two drawbacks. First, the additional thickness that is added to the lighting unit makes it impractical for low-profile displays of art, that would be common in a residence. And second, the successive rows of LEDs consume significantly more power than a single LED light strip, making such a device impractical for use with battery power.

The second way to backlight a photograph or artwork display is to employ an LED light strip that shines directly into at least one edge of a light guide panel that is configured as a mid-layer member of the light tile assembly. However, because there is no uniform air-gap to diffuse the LEDs, the issue of LED "hotspots" remains a problem that still needs to be solved. The common way to deal with LED "hotspots" in a low-profile construction (as prior art demonstrates) is to print a black border or frame on a layer above the LEDs so the border or frame blocks out or conceals the LED "hotspots." This type of LED "hotspot" blocking is common and conventional, indeed this is the solution of the prior art discussed above. But this has a significant drawback that it cannot provide frameless, edge-to-edge illumination.

Therefore, there exists a need for a thin, frameless, low-profile light tile for illuminating a photograph or artwork display that may be powered by a battery.

SUMMARY

The present invention relates to the novel construction of a frameless (edge-to-edge illuminated), low-profile light tile that employs a self-adhesive, removable/exchangeable, photograph or artwork overlay. The low-profile light tile may use a single LED light strip to illuminate the assembly, and the light tile may be programmed or tuned on or off via a wireless remote control. The light tile does not need to be illuminated to beautifully display photographs or artwork—high-resolution printing ensures the image looks crisp and clear without illumination. Additionally, the light tile assembly employs a novel means for removably attaching to interior house walls, and it may also be used as a table or countertop display. When the light tile is mounted to a wall, it is powered via an ultra-thin removable and rechargeable Lithium-ion battery; however, when the light tile is utilized as a table or countertop display, it may be powered by the ultra-thin removable and rechargeable battery, or it may be powered by a standard USB cord that plugs into a standard wall socket.

The low-profile light tile assembly may come in a kit that includes: a low-profile light tile, a self-adhesive removable/exchangeable photograph or artwork overlay, a self-releasing male plug wall mount sub-assembly, an ultra-thin removable and rechargeable battery, a wireless remote control, a standard USB cord assembly, a battery charging station, a folding countertop display stand that includes a male plug-mounting structure, and an optional front-surface-mounting picture frame.

Specifically, the light tile assembly disclosed includes a main body with four semi-rigid side walls that define a volume. Additionally, there is a top overlay sub-assembly adjacent to the top of the main body, and a mid-layer illumination sub-assembly disposed of in the main body volume. The top overlay sub-assembly includes a semi-rigid transparent plastic cover sheet, a colored ink layer an opaque-white ink layer that may be formed by one or more white ink layers that are bonded together to form one layer and a double-sided tape layer. The mid-layer illumination sub-assembly includes a thick translucent milky-white diffusion layer, a light guide panel, a light blocking, internally reflective, material strip (that may be metal or foil) applied to at least two side edges of the light guide panel, a light emitting diode (LED) strip adjacent to at least one side edge of the light guide panel and a thin opaque reflective sheet that is located adjacent to the bottom of the light guide panel. The thick translucent milky-white diffusion layer is preferably ⅛ inch thick, but may be 1/16-3/16 inch thick and has a top and bottom; the thick translucent milky-white diffusion layer extends to the semi-rigid side walls. The light guide panel is adjacent to the bottom of thick translucent milky-white diffusion layer, the light guide panel has a top and a bottom and four side edges and the light guide panel extends to within ⅛ inch of the outer edge of the assembly. The double-sided tape layer removably adheres to the top of the thick translucent milky-white diffusion layer. And, a main body base structure is located adjacent to the bottom of the thin opaque reflective sheet.

A release liner may be adhered to the bottom of the double-sided tape layer, such that the release liner is removed prior to adhering the top overlay sub-assembly to the top of the thick translucent milky-white diffusion layer. The top surface of the thick translucent milky-white diffusion layer may have a frosted or sandblasted texture that extends to the semi-rigid side walls. The colored ink layer may be printed in reverse on the backside of a semi-rigid transparent plastic cover sheet, and an opaque-white ink layer may be printed behind the colored inks.

An outside surface of the main body base structure may have a recessed battery cavity and a battery disposed of in the recessed battery cavity. The battery may be rechargeable. The battery is constructed to be flush with, or within 3/32 inch from the outside surface of the main body base. The recessed battery cavity may have a magnet to magnetically couple to the battery, and/or it may have a compression foam strip or metal spring clip(s) to retain the battery. The recessed battery cavity may have finger-grab cutouts.

The main body base structure may further include a printed circuit board (PCB) cavity, and a PCB connected to the battery and the LED strip, wherein the PCB is disposed of in the PCB cavity. The PCB may include an efficient LED driver circuit. The PCB may include a wireless remote-control receiver, such that the LED strip can be controlled by a wireless remote control.

The main body base structure may include a micro-size USB receptacle that is accessible from the outside surface of the light tile main body, and may have a micro-size female USB receptacle mounting wall. The USB receptacle may be connected to a power source, and the power source provides power to the LED strip.

The light tile may have a front-surface-mounting picture frame.

The outside surface of the main body base structure may have a female wall mount recess and a magnet is disposed of in the female wall mount recess. A male wall mount plug with a ferromagnetic material may magnetically couple to the magnet. The back surface of the male plug may have a self-releasing double-sided adhesive foam strip. The male plug may also use a permanent adhesive to adhere to a folding countertop display stand. A surface tension layer may be applied between the magnet and the ferromagnetic material. When a display stand is used, the stand may have a through hole that aligns with the USB receptacle on the back side of the main body base structure.

The light tile may be sold as a kit that includes a rechargeable and removable battery that is substantially a rectangular cube with a depth, width, and length: wherein the width or length is at least ten times that of the width; wherein the length is at least two times that of the width; and wherein the depth and width define a battery charging surface. The kit may also include a battery charging station with a base and a top, the top comprising a plurality of closely grouped charging ports, each port sized to accommodate the battery charging surface. When the battery is inserted into the charging port, the length dimension of the battery is substantially orthogonal to the base of the charging station.

Additional aspects, alternatives and variations as would be apparent to persons of skill in the art are also disclosed herein and are specifically contemplated as included as part of the invention. The invention is set forth only in the claims as allowed by the patent office in this or related applications, and the following summary descriptions of certain examples are not in any way to limit, define or otherwise establish the scope of legal protection.

BRIEF DESCRIPTION OF DRAWINGS

The invention can be better understood with reference to the following figures. The components within the figures are not necessarily to scale, emphasis instead being placed on clearly illustrating example aspects of the invention. In the figures, like reference numerals designate corresponding parts throughout the different views and/or embodiments. Furthermore, various features of different disclosed embodiments can be combined to form additional embodiments, which are part of this disclosure. It will be understood that certain components and details may not appear in the figures to assist in more clearly describing the invention.

FIG. 1A1 is a top isometric view of the light tile assembly, wherein the photograph or artwork overlay is shown mounted to the light tile main body, and alongside the light tile is a wireless remote control.

FIG. 1C is a top exploded view of the light tile assembly.

FIG. 1D illustrates four side views of the light tile assembly.

FIG. 1E is a back isometric view of the light tile assembly, wherein the wall mount sub-assembly and battery are shown mounted to the back wall of the light tile.

FIG. 1E1 is a back exploded view of the light tile assembly, wherein the wall mount sub-assembly and battery are shown exploded away from the light tile assembly.

FIG. 1G1 is an enlarged cross-sectional view of the female wall mount recess.

FIG. 1G2 is an enlarged exploded view of the neodymium magnet sub-assembly.

FIG. 1H1 is a top exploded view of the male plug wall mount sub-assembly.

FIG. 1H2 is a back exploded view of the male wall mount sub-assembly.

FIG. 1P1 is a top enlarged view of a portion of the linear edge of the light guide panel, wherein additionally, the linear edge is located adjacent to the LED light strip.

FIG. 1P2 is a bottom enlarged view of a portion of the bottom surface of the light guide panel.

FIG. 1Q1 is a back isometric view of the light tile assembly, wherein the light tile is shown mounted to the folding countertop display stand.

FIG. 1Q2 is a side view of the light tile assembly, wherein the light tile is shown mounted to the folding countertop display stand.

FIG. 1Q3 is a top exploded view of the light tile assembly, wherein the light tile is shown exploded away from the display stand, and the male plug sub-assembly is highlighted.

FIG. 1Q4 is a back exploded view of the light tile assembly, wherein the light tile is shown exploded away from the folding countertop display stand.

FIG. 1R1 is a back exploded view of the male plug sub-assembly.

FIG. 1T is a top isometric view that shows the light tile assembly mounted to the folding display stand, and alongside the mounted light tile is a standard USB cord assembly.

FIG. 1T1 is a back isometric view of the light tile assembly and display stand, wherein a standard USB cord assembly is shown plugged into the backside of the light tile assembly.

FIG. 1T2 is a back exploded view of the light tile assembly and display stand, and also featured is a standard USB cord assembly.

FIG. 1U1 is a top isometric view of a two-port battery charging station, shown charging two batteries, wherein the charging station features full-charge indicator lights, and also shown is a standard USB cord assembly.

FIG. 1U2 is a top isometric view of a four-port battery charging station, shown charging four batteries, wherein the charging station features full-charge indicator lights, and also shown is a standard USB cord assembly.

FIG. 1U3 is a top exploded view of the four-port battery charging station, wherein the four batteries are shown elevated above the charging station.

FIG. 1V is a top isometric view of various components that may come in a kit for one countertop display application.

FIG. 1V1 is a top isometric view of various components that may come in a kit for one wall mount application and one countertop application.

FIG. 1V2 is a top isometric view of various components that may come in a kit for two wall mount applications and two countertop applications.

FIG. 1V3 is a top isometric view of various components that may come in a kit for four wall mount applications and two countertop applications.

FIG. 1W is a top isometric view of the light tile assembly, wherein a picture frame is mounted to the front of the light tile.

FIG. 1W1 is a back isometric view of the light tile assembly, wherein a light tile is inserted into a back opening in the picture frame.

FIG. 1W2 is a top exploded view of the light tile assembly, wherein the picture frame is shown elevated above the light tile.

FIG. 1W3 is a back exploded view of the light tile assembly, wherein the light tile is shown elevated above the picture frame.

FIG. 1W4 is a back isometric view of the light tile assembly, wherein the picture frame is shown mounted to the light tile.

FIG. 1W5 is a back exploded view of the light assembly and picture frame, wherein the male plug wall mount sub-assembly is shown exploded away from the female wall mount recess.

DETAILED DESCRIPTION

Reference is made herein to some specific examples of the present invention, including any best modes contemplated by the inventor for carrying out the invention. Examples of these specific embodiments are illustrated in the accompanying figures. While the invention is described in conjunction with these specific embodiments, it will be understood that it is not intended to limit the invention to the described or illustrated embodiments. To the contrary, it is intended to cover alternatives, modifications, and equivalents as may be included within the spirit and scope of the invention as defined by the appended claims.

In the following description, numerous specific details are set forth in order to provide a thorough understanding of the present invention. Particular example embodiments of the present invention may be implemented without some or all of these specific details. In other instances, process operations well known to persons of skill in the art have not been described in detail in order not to obscure unnecessarily the present invention. Various techniques and mechanisms of the present invention will sometimes be described in singular form for clarity. However, it should be noted that some embodiments include multiple iterations of a technique or multiple mechanisms unless noted otherwise. Similarly, various steps of the methods shown and described herein are not necessarily performed in the order indicated, or performed at all in certain embodiments. Accordingly, some implementations of the methods discussed herein may include more or fewer steps than those shown or described. Further, the techniques and mechanisms of the present invention will sometimes describe a connection, relationship or communication between two or more entities. It should be noted that a connection or relationship between entities does not necessarily mean a direct, unimpeded connection, as a variety of other entities or processes may reside or occur between any two entities. Consequently, an indicated connection does not necessarily mean a direct, unimpeded connection unless otherwise noted.

Figure 1A:
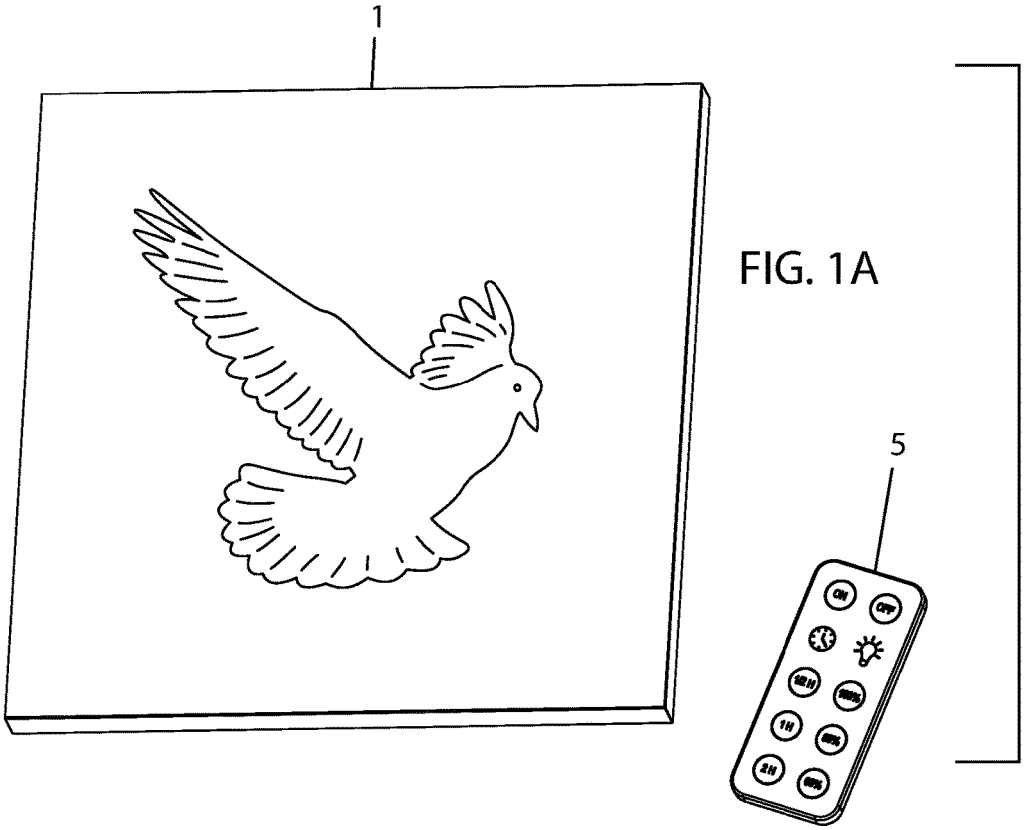
FIG. 1A is a top isometric view of the light tile assembly, wherein the photograph or artwork overlay is shown mounted to the light tile main body, and alongside the light tile is a wireless remote control.

The following list of example features corresponds with FIGS. 1A-1W5 and is provided for ease of reference, where like reference numerals designate corresponding features throughout the specification and figures:

1. Low-profile light tile assembly
2. Self-adhesive, removable/exchangeable photograph or artwork overlay
3. Release liner
4. Light tile main body
5. Wireless remote control
6. Ultra-thin removable and rechargeable battery
7. Male plug wall mount sub-assembly
8. Female wall mount recess
9. Neodymium magnet sub-assembly
10. Metal battery casing
11. Recessed battery cavity
12. Finger-grab cutouts
13. Power-receiving plates
14. Flat magnet layer
15. Compression foam strip
16. Flat, round neodymium magnet
17. Silicone or surface tension layer
18. Magnet sub-assembly double-sided adhesive layers
19. Adhesive anchor wall
20. Magnet sub-assembly cavity
21. Metal disk with crimp tabs
22. Male wall mount plug
23. Self-releasing double-sided adhesive foam strips
24. Crimp-tab through hole slots
25. Crimp-tab pocket cavities
26. Top overlay sub-assembly
27. Semi-rigid transparent plastic cover sheet
28. Colored ink layer
29. Opaque-white ink layer
30. Permanent/removable double-sided tape layer
31. Mid-layer illumination sub-assembly
32. Frosted or sandblasted texture
33. Thick, translucent, milky-white diffusion layer
34. Light guide panel
35. Self-adhesive, light-blocking, internally reflective material strip
36. Thin opaque-white reflective layer
37. Main body base structure/housing unit
38. Ultra-thin, semi-rigid, sidewall concealing strips with a self-adhesive backing
39. PC board
40. LED light strip
41. Micro-size female USB receptacle mounting wall
42. Micro-size female USB receptacle
43. Efficient LED driver circuit
44. Wireless remote-control receiving tower
45. PC board cavity
46. Ultra-thin light guide panel retaining walls
47. Ultra-thin led light strip mounting wall
48. Top-surface light guide pattern
49. Linear-edge light guide pattern
50. Bottom-surface light guide pattern
51. Folding countertop display stand
52. Male plug sub-assembly
53. Male plug
54. Permanent adhesive layer
55. Standard USB cord assembly
56. Standard-size male USB plug
57. Micro-size male USB plug
58. Through hole
59. Two-port battery charging station
60. Full-charge indicator lights
61. Four-port battery charging station
62. Front-surface-mounting picture frame
63. USB transformer plug
64. Microphone

OVERVIEW

The low-profile light tile of the present invention employs a self-adhesive, removable/exchangeable photograph or artwork overlay. The light tile is designed to provide frameless edge-to-edge illumination to the photograph or artwork overlay. However, the light tile does not need to be illuminated to beautifully display a photograph or artwork image.

The low-profile light tile may employ eight layers including two ink layers and one adhesive layer. These layers work together to achieve the specific design objectives that are set forth by the present invention.

The eight-layer construction can further be described as a multi-layer assembly that employs (from top to bottom—the top being the side that displays the photograph or artwork image) a top overlay sub-assembly comprising four layers that include (from top to bottom), a semi-rigid transparent plastic cover sheet, a colored ink layer, an opaque white ink layer (that may include two or more layers of white that are printed in rapid succession and therefore bond together to form one layer), and a permanent/removable double-sided tape layer. Next is a mid-layer illumination sub-assembly comprising three layers that include (from top to bottom) a thick (preferably ⅛ inch thick, but may be ⅛-3/16 inch thick) translucent, milky-white diffusion layer, a light guide panel (which may include a light guide pattern along the edge that is adjacent to the LED strip and may also include a light guide pattern on one or two sides of the panel), and a thin opaque-white reflective layer. And finally, at the bottom of the light tile assembly is a main body base structure/housing unit. It is worth noting that the top surface of the thick, translucent, milky-white layer (which is part of the mid-layer illumination sub-assembly) may be frosted or have a sandblasted texture to increase the diffusion properties that are employed by this layer; or the top surface may be frosted or have a sandblasted texture to help reduce the surface tension between the top overlay adhesive layer and the top surface of the milky-white diffusion layer so that the top overlay sub-assembly is easier to peel away from top surface of the light tile when one photo or artwork image is being replaced by another photo or artwork image.

The present invention employs a unique combination of layers that eliminate "hotspots" while providing edge-to-edge illumination in a low-profile embodiment. The LED "hotspot" blocking layers are created by combining the opaque-white ink layer from the top overlay sub-assembly, with the 1/16-3/16 inch-thick, translucent, milky-white diffusion layer from the mid-layer illumination assembly. A uniform air-gap is not necessary between these layers to help diffuse the LED "hotspots," but instead, diffusion is achieved via the thicknesses of the 1/16-3/16 inch-thick, translucent, milky-white layer and the opaque properties of the opaque-white ink layer. Instead of a uniform air-gap between these layers, there is an adhesive layer that removably adheres them together. The colored ink layer from the top overlay sub-assembly, and the optional frosted or sandblasted texture that may be employed on the top surface of the thick, translucent, milky-white layer may also contribute to diffusing or blocking the LED "hotspots."

The other novel aspect of the low-profile light tile assembly is frameless or edge-to-edge illumination. Frameless illumination allows photographs or artwork to be "tiled" together without the interference of a frame or border between the images. Edge-to-edge illumination in a thin embodiment is a difficult design challenge that is addressed via the following solutions. First, seven of the eight layers of the low-profile light tile assembly extend to within 0.0625 inches or less from the exterior surface of the sidewalls of the light tile assembly; and the eighth layer, which is the colored ink layer, may also extend to within 0.0625 inches or less from the exterior surface of the sidewalls; however, this is not a mandatory requirement for the colored ink layer. Additionally, the bottommost layer of the light tile assembly, i.e., the main body base structure/housing unit, also employs ultra-thin light guide retaining walls that do not extend inward more than 0.0625 inches from the exterior surface of the sidewalls of the embodiment. To be more specific, the top four layers of the top overlay sub-assembly and the thick, translucent, milky-white diffusion layer of the mid-layer illumination sub-assembly extend to within 0.015 inches or less from the exterior surface of the sidewalls of the light tile assembly. Together, these top five layers cantilever over the exterior edges of the light guide panel by not more than 0.125 inches. If these layers cantilever more than 0.125 inches, proper illumination will not reach the perimeter edges of the lighting assembly. The preferred cantilever overhang is approximately 0.0625 inches or less. And last, edge-to-edge illumination of the light tile assembly is made possible by employing four ultra-thin, semi-rigid, sidewall concealing strips with a self-adhesive backing. One long concealing strip that folds at the corners of the sidewalls is also a viable configuration. Put more simply, light is able to travel to the edges of the assembly because the sidewalls of the light tile are extremely thin. Basically, the sidewalls of the light tile assembly are preferably formed by four simple, thin, semi-rigid strips that adhere to the exterior sidewalls or edges of the main body base structure/housing unit and the exterior edges of the thick, translucent, milky-white diffusion layer. Ultra-thin sidewalls provide edge-to-edge illumination for the photograph or artwork overlay.

In addition to achieving a thin, frameless lighting assembly, three additional design objectives are addressed: first, create a low power light tile that may be powered by an unobtrusive, compact battery; second, create a consumer-friendly lighting assembly that may be easily hung on a wall without using nails; and third, create a lighting assembly that provides illumination without using unsightly cords or wires.

After multiple considerations, an ultra-thin removable and rechargeable Lithium-ion battery was selected for powering the low-profile light tile. The ultra-thin battery (for example) is preferably 4.5 millimeters thick, has a capacity of 3500 mAh or 4000 mAh, and may be 3.7 volts. The dimensions of a preferred battery are 123 mm×57 mm×4.5 mm. The proper selection of an ultra-thin removable and rechargeable battery to power the assembly requires several considerations. First, the battery will need to be repeatedly removed from the backside of the light tile assembly while it is mounted to the wall, which presents numerous design challenges. Once the ultra-thin rechargeable battery has been removed from the wall-mounted light tile assembly, it needs to be transferred to a charging station where it is fully recharged and then replaced within the light tile assembly that has been remounted to the wall while the battery was recharging. Hence, removing, recharging, and replacing the battery is a fairly labor-intensive process that suggests that if a rechargeable battery is to be a viable component of the assembly, an effortless and seamless wall-mounting system needs to be developed.

To hang the light tile, an innovative mounting solution is offered by the present invention. A male and female coupling system is disclosed that uses a neodymium magnet for attraction, and a silicone or surface tension layer that provides axis-based dial-in leveling. The quick and easy wall mounting system includes a male wall mount sub-assembly, and a female wall mount recess that is located in the center of the back wall of the light tile main body base structure. The female wall mount recess employs a flat, round neodymium magnet and silicone layer that rest within a magnet cavity that is located at the bottom of the female receptacle; and the male wall mount sub-assembly employs a round metal disk that is mounted on top of a round male plug, and self-releasing adhesive strips are adhered to the backside of the male plug wall mount sub-assembly.

The operation of the wall mount system is simple and allows the ultra-thin rechargeable battery to be effortlessly replaced at will. The female receptacle employs a cavity that contains a magnet that is attracted to the metal disk mounted to the top surface of the male plug; between these two parts is a silicone layer (or other material such as rubber) that provides surface tension between these parts while they mate. The surface tension from the silicone layer allows the light tile to hold its rotational position after the light tile has been leveled on the wall.

Another novel aspect of the mounting system is the self-releasing adhesive strips that mount to the backside of the male plug wall mount sub-assembly. These adhesive strips do not damage walls, and they release by pulling a tab that stretches the foam strip and releases the adhesive. Currently, the best choice for self-releasing foam strips is 3M Command Strips. An additional unique feature of the mounting system is how easy it is to apply the male plug wall mount sub-assembly to the wall—to do this, the consumer simply pre-attaches the male plug wall mount sub-assembly to the back of the light tile via the magnet, then the release liner is removed from the self-releasing adhesive strips, and the light tile is lifted into position and then gently pressed against the wall, which leaves the male wall mount sub-assembly mounted to the wall via the pre-exposed adhesive. When the light tile is lifted away from the wall, the magnet releases before the adhesive on the self-releasing foam strips so the male plug wall mount sub-assembly remains fastened to the wall.

This system for attaching the male plug wall mount sub-assembly to the wall is particularly convenient when placing multiple light tiles in a "tiled" pattern where the edge of one light tile butts up to the edge of the adjacent light tile.

When the light tile is used as a countertop display, the light tile uses an almost identical male/female magnet-based mounting system, except, instead of using self-releasing foam strips, the male plug sub-assembly that attaches to the folding countertop display stand uses a permanent adhesive layer so the male plug sub-assembly stays permanently attached to the countertop display stand. So when the light tile is used as a countertop display, it mounts to the countertop display stand in a similar way to how the light tile mounts to a wall.

Although a male/female magnet-based mating system is preferred for mounting the light tile to a wall, a neodymium magnet can be very expensive; therefore, instead of a magnet-based mating system, the light tile may simply employ a hole and/or slot, or sawtooth-shaped inset, that is configured in the back wall of the assembly, and a screw or nail that mates with the hole/slot or sawtooth-shaped inset may be simply placed in the wall where the light tile will be located. For the sake of brevity, a hole/nail mounting system is not illustrated; however, this type of simple mounting system is easy to visualize.

In addition to a quick and easy magnet-based wall mounting system, the light tile employs other novel features that facilitate easy battery removal. First, the battery is engineered to reside within a recessed battery cavity, and a flat magnet layer is located at the bottom of the recessed cavity. Next, the battery may employ a metal casing so the casing is magnetically attracted to the flat magnet layer that is located at the bottom of the recessed battery cavity. Because a magnetic attraction is responsible for holding the battery within the cavity, there is no need for a battery cover. The absence of a battery cover makes it easier to grab and remove the battery from the light tile assembly. Additionally, finger-grab cutouts are provided to make it easier to grab the battery while removing it from the recessed battery cavity.

DISCUSSION REFERENCING DRAWINGS

Now the actual construction of the light tile will be explained with reference to the series of detailed drawings. In FIG. 1A, the low-profile light tile assembly 1 is shown from a top isometric view, along with a wireless remote control 5. FIG. 1A shows the self-adhesive removable/exchangeable photograph or artwork overlay 2 (see FIG. 1B) adhered to the top surface of the light tile main body 4 (see FIG. 1B). The photograph or artwork overlay 2 employs a gloss surface because the colored image is printed on the backside of a semi-rigid transparent plastic cover sheet 27 (shown in FIG. 1M). Because the photograph or artwork image 2 is printed on a plastic sheet, it is best to print the image on machinery that uses UV or LED curable inks.

Figure 1B:
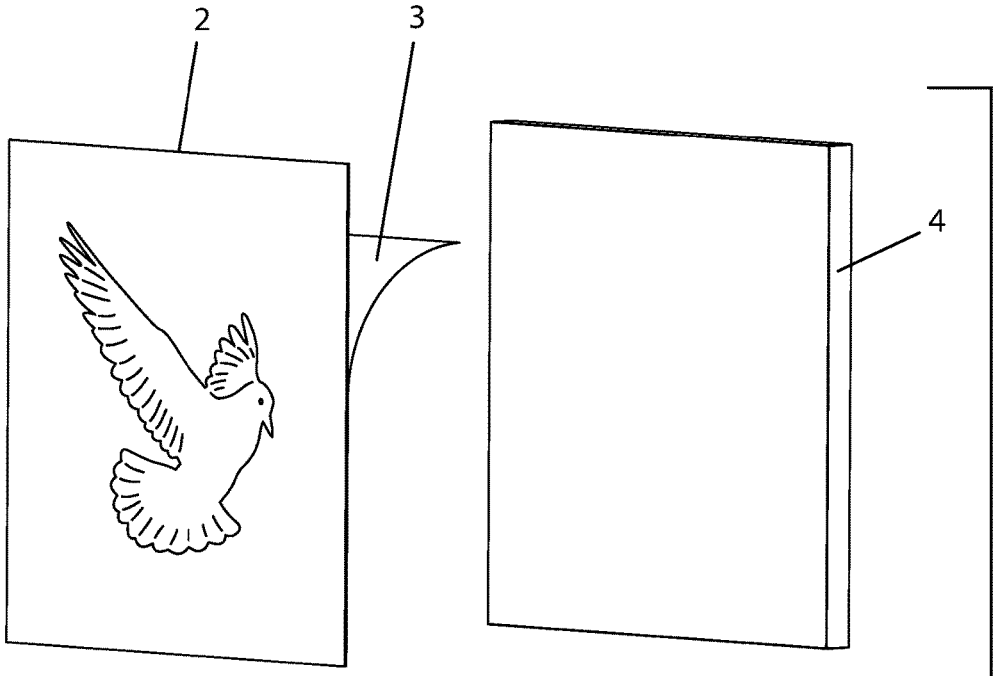
FIG. 1B is a top exploded view of the light tile assembly, wherein the overlay is shown elevated above the light tile main body.

FIG. 1B shows the top exploded view of the light tile assembly 1 wherein the photograph or artwork overlay 2 is shown elevated above the light tile main body 4. The light tile main body 4 may come with the self-adhesive removable/exchangeable photograph or artwork overlay 2 already applied, or the overlay 2 may be applied by the consumer. If the overlay 2 is applied by the consumer, a release liner 3 must be removed from the backside of the photograph or artwork overlay 2 before the overlay 2 is applied to the top surface of the light tile main body 4. Before the top overlay 2 has been applied to the top surface of the light tile main body 4, the main body 4 has a modern/monolithic appearance wherein all the internal components of the assembly are hidden or integrated within the external walls of the light tile main body 4.

FIG. 1A1 shows a top isometric view that is the same as FIG. 1A. FIG. 1C shows a top exploded view of the embodiment wherein the release liner 3 has been removed from the photograph or artwork overlay 2, and the overlay 2 is shown elevated above the light tile main body 4.

FIG. 1D shows four side views of the low-profile light tile assembly 1. Although eight layers are incorporated into the construction of the low-profile light tile assembly 1, the overall height is minimal and measures approximately 0.50 inches.

FIG. 1E shows an isometric back view of the low-profile light tile assembly 1, wherein two main components of the assembly are clearly visible: the ultra-thin removable and rechargeable battery 6, and the male plug wall mount sub-assembly 7. The male plug wall mount sub-assembly 7 will be discussed in further detail in FIGS. 1G-1I. The ultra-thin rechargeable battery 6 may employ a Lithium-ion construction, is preferably 4.5 millimeters thick, may have a 3500 mAh or 4000 mAh capacity, and may have a 3.7 volt rating. FIG. 1E shows both the ultra-thin rechargeable battery 6 and male plug wall mount sub-assembly 7 mounted to the backside of the low-profile light tile assembly 1, while FIG. 1E1 shows these components exploded from their respective mating cavities. FIG. 1E1 additionally exhibits a female wall mount recess 8 that mates with the male plug wall mount sub-assembly 7, and a neodymium magnet sub-assembly 9 that employs a flat, round neodymium magnet 16 (FIGS. 1G-1G2) that mates with the metal disk 21 (FIGS. 1H-1I) that is mounted on top of the male wall mount plug 22 (FIGS. 1H-1I) that is part of the male wall mount sub-assembly 7.

Figure 1F:
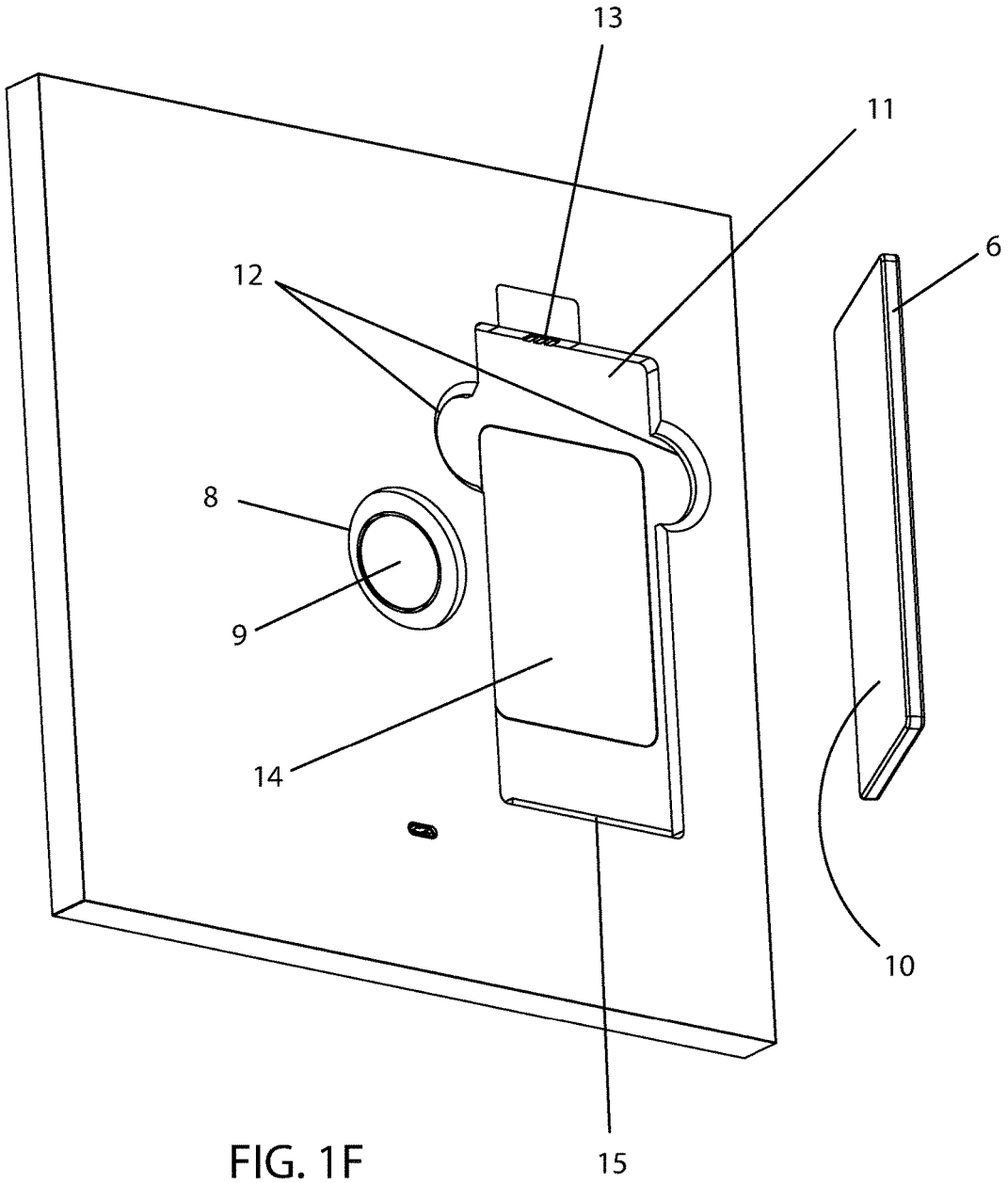
FIG. 1F is a back exploded view of the light tile assembly, wherein various features are highlighted, and the battery is shown exploded away from the recessed battery cavity.

FIG. 1F shows a back exploded view of the assembly wherein the ultra-thin removable and rechargeable battery 6 is featured, but the male plug wall mount sub-assembly is not shown, so more focus is placed on other components. Other components of the assembly that are featured in FIG. 1F are: a metal battery casing 10, a recessed battery cavity 11, finger-grab cutouts 12, power receiving plates 13, and a flat magnet layer 14.

One of the main concepts that makes a wall-mounted light tile feasible is the ease with which the ultra-thin battery 6 can be easily removed from the assembly even while the assembly has been mounted to a wall. Once the low-profile light tile assembly 1 has been removed from the wall, additional features make it easy to remove the ultra-thin battery 6 from the assembly. The ultra-thin battery 6 is designed to reside within a recessed battery cavity 11, and a flat magnet layer 14 is located at the bottom of the cavity 11. Next, the ultra-thin battery 6 may employ a metal battery casing 10 so the casing 10 is magnetically attracted to the flat magnet layer 14, which is located at the bottom of the recessed battery cavity 11. Because a magnetic attraction is responsible for holding the battery within the cavity, there is no need for a battery cover. The absence of a battery cover makes it easier to grab and remove the ultra-thin battery 6 from the recessed battery cavity 11. Additionally, finger-grab cutouts 12 are provided to make it easier to grab the battery 6 from the recessed battery cavity 11. The ultra-thin rechargeable battery 6 is flush with the outside surface of the main body 4, but may extend from it 3/32 of an inch.

Figures 1G, 1H, 1I:
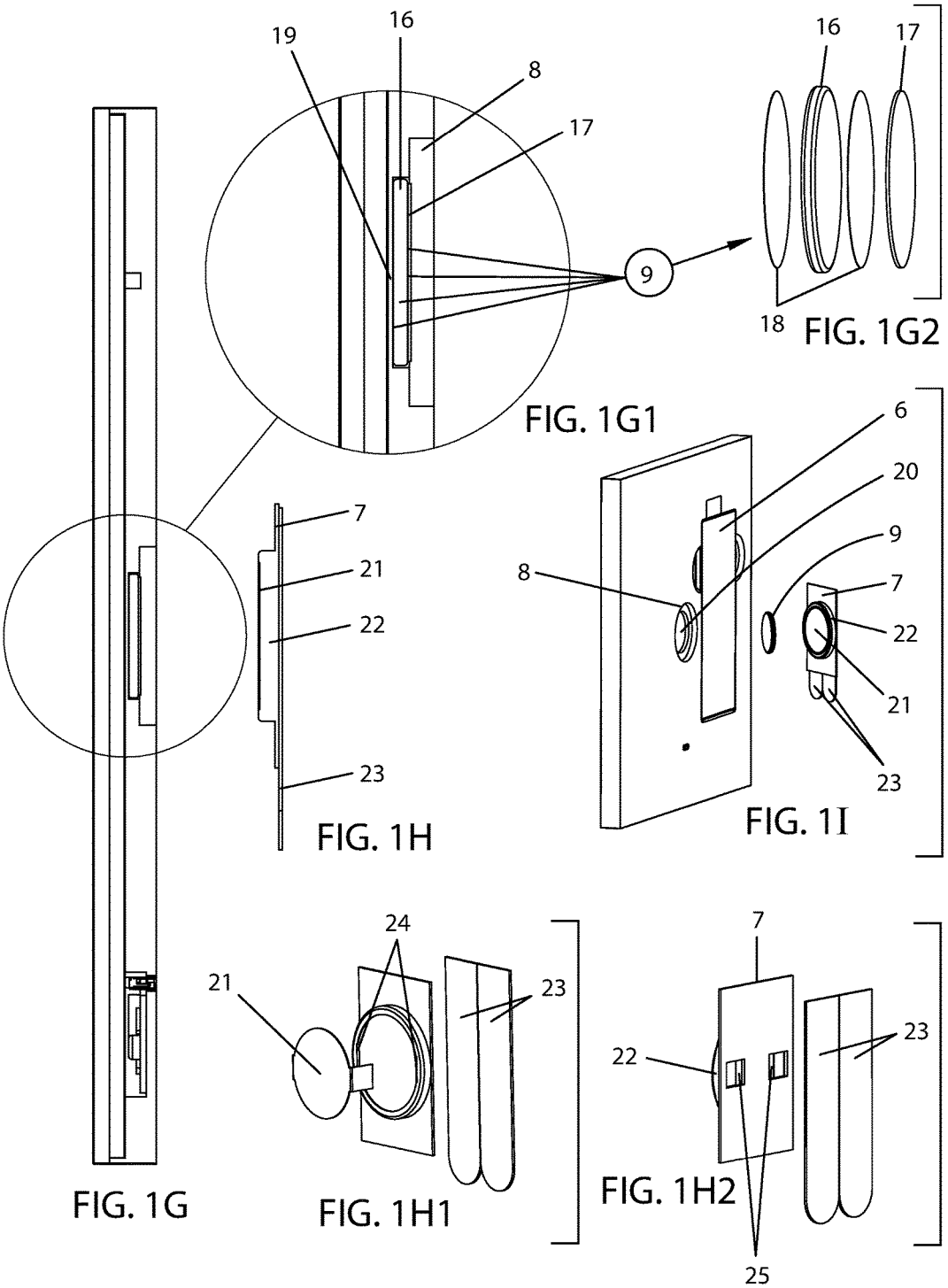
FIG. 1G is a cross-sectional side view of the light tile assembly, wherein the female wall mount recess is highlighted.
FIG. 1H is a cross-sectional side view of the male plug wall mount sub-assembly.
FIG. 1I is a back exploded view of the light tile assembly, wherein the neodymium magnet sub-assembly and male wall mount sub-assembly are shown exploded away from the light tile assembly.

Because the light tile 1 uses a ultra-thin rechargeable battery 6, the tile must be easily removed from its mount to make battery replacement simple. Therefore, a novel means for removably attaching the light tile assembly to a wall is disclosed. FIG. 1G shows a cross-sectional side view of the low-profile light tile assembly 1 wherein the female wall mount recess 8 and neodymium magnet sub-assembly 9 are highlighted features of the embodiment. In FIG. 1G1, the female wall mount recess 8 and the neodymium magnet sub-assembly 9 are shown in greater detail via an enlarged cross-sectional side view that shows the internal construction of the low-profile light assembly 1.

FIGS. 1G-1I show the innovative mounting solution offered by the present invention. The solution comprises a male and female coupling system that utilizes a flat, round neodymium magnet 16, and a silicone or surface tension layer 17 (FIGS. 1G-1G2) that provides axis-based dial-in leveling. More specifically, the quick and easy wall mounting system includes a male wall mount sub-assembly 7, and a female wall mount recess 8 that is located in the center of the back wall of the light tile main body base structure. The female wall mount recess 8 employs a flat, round neodymium magnet 16 and silicone layer 17 that rest within a magnet sub-assembly cavity 20, (FIG. 1I) which is located at the bottom of the female receptacle 8; and the male wall mount sub-assembly 7 employs a round metal disk with crimp tabs 21 that is mounted on the top of a male wall mount plug 22 (FIGS. 1H-1I), and self-releasing double-sided adhesive foam strips are adhered to the backside of the male plug wall mount sub-assembly 7.

The way the wall mount system works is simple and allows the ultra-thin rechargeable battery 6 to be effortlessly replaced at will. The female receptacle 8 employs a magnet sub-assembly cavity 20 that contains a neodymium magnet 16, which is attracted to the metal disk 21 that is mounted on the top of the male wall mount plug 22; between these two parts is a silicone layer 17 (or other material such as rubber) that provides surface tension between these parts while they mate. When the desired level position is achieved, the silicone layer 17 will hold that position. FIG. 1G1 and FIG. 1G2 show that the flat, round neodymium magnet 16 adheres to an adhesive anchor wall 19 via a magnet sub-assembly double-sided adhesive layer 18; and the silicone or surface tension layer 17 adheres to the neodymium magnet 16 via an additional magnet sub-assembly double-sided adhesive layer 18.

FIGS. 1H-1H2 show the male plug wall mount sub-assembly 7 from a cross-sectional side view, a top exploded view, and a back exploded view. Shown in all three of these figures is: the male plug wall mount sub-assembly 7, the metal disk with crimp tabs 21, the crimp-tab through hole slots 24, the crimp-tab pocket cavities 25, the male wall mount plug 22, and the self-releasing double-sided adhesive foam strips 23. Although it is not shown in the drawings, the metal disk 21 may also adhere to the top surface of the male wall mount plug 22 via a double-sided adhesive layer. The self-releasing double-sided adhesive foam strips 23 that mount to the backside of the male plug wall mount sub-assembly 7 are designed so they do not damage walls. Currently, the best choice for self-releasing foam strips is 3M Command strips. FIG. 1I shows a back exploded view of the low-profile light tile assembly 1, wherein all the components of the male and female coupling system are shown exploded away from their respective mating cavities.

Figure 1J:
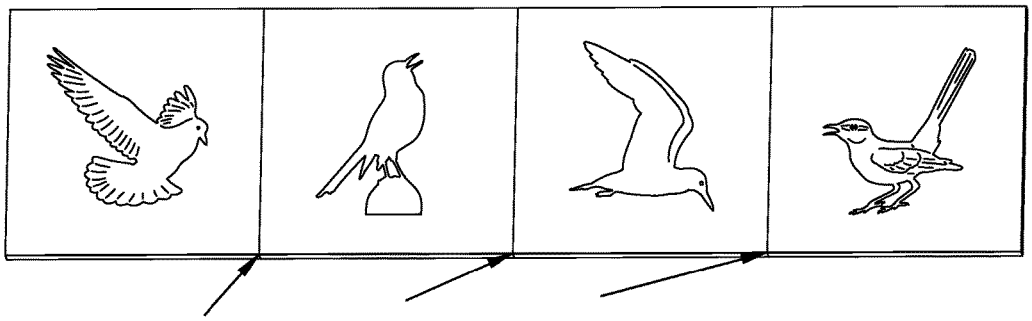
FIG. 1J is a top isometric view of four light tile assemblies that are shown "tiled" together, wherein the adjoining edges between the light tiles touch one another, and alongside the light tile is a wireless remote control.

FIG. 1J shows four light tiles from a top isometric view mounted to a wall wherein edge-to-edge illumination allows the photographs or artwork to be "tiled" together without the interference of a frame or border between the images. When the light tiles 1 are configured in a square shape, they can easily be "tiled" together in a horizontal row, or vertical row depending upon the application. The light tile 1 can also be configured in other shapes such as a rectangle, or if the size of the light tile 1 is increased to a larger format display, then light tile 1 may employ one or more additional LED light strips 40 (see FIG. 1M).

Figure 1K:
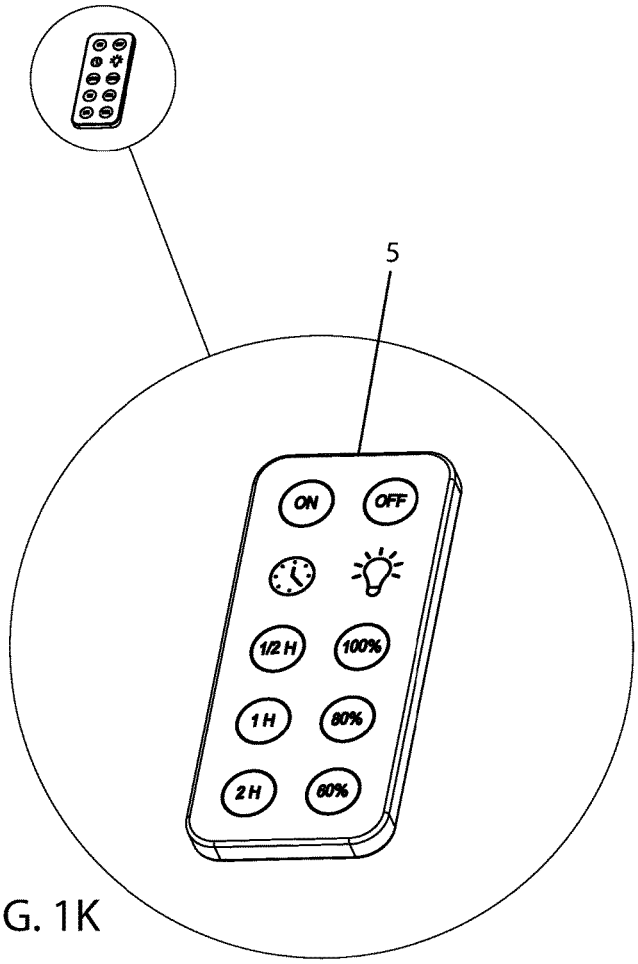
FIG. 1K is a top isometric view of the wireless remote control, wherein power-saving options are clearly visible.

FIG. 1K shows a top isometric view of the wireless remote control 5. The wireless remote control 5 may employ settings that allow the light tile 1 to conserve power, thereby extending the power storage or recharge cycle of the ultra-thin Lithium-ion battery 6.

Figure 1L:
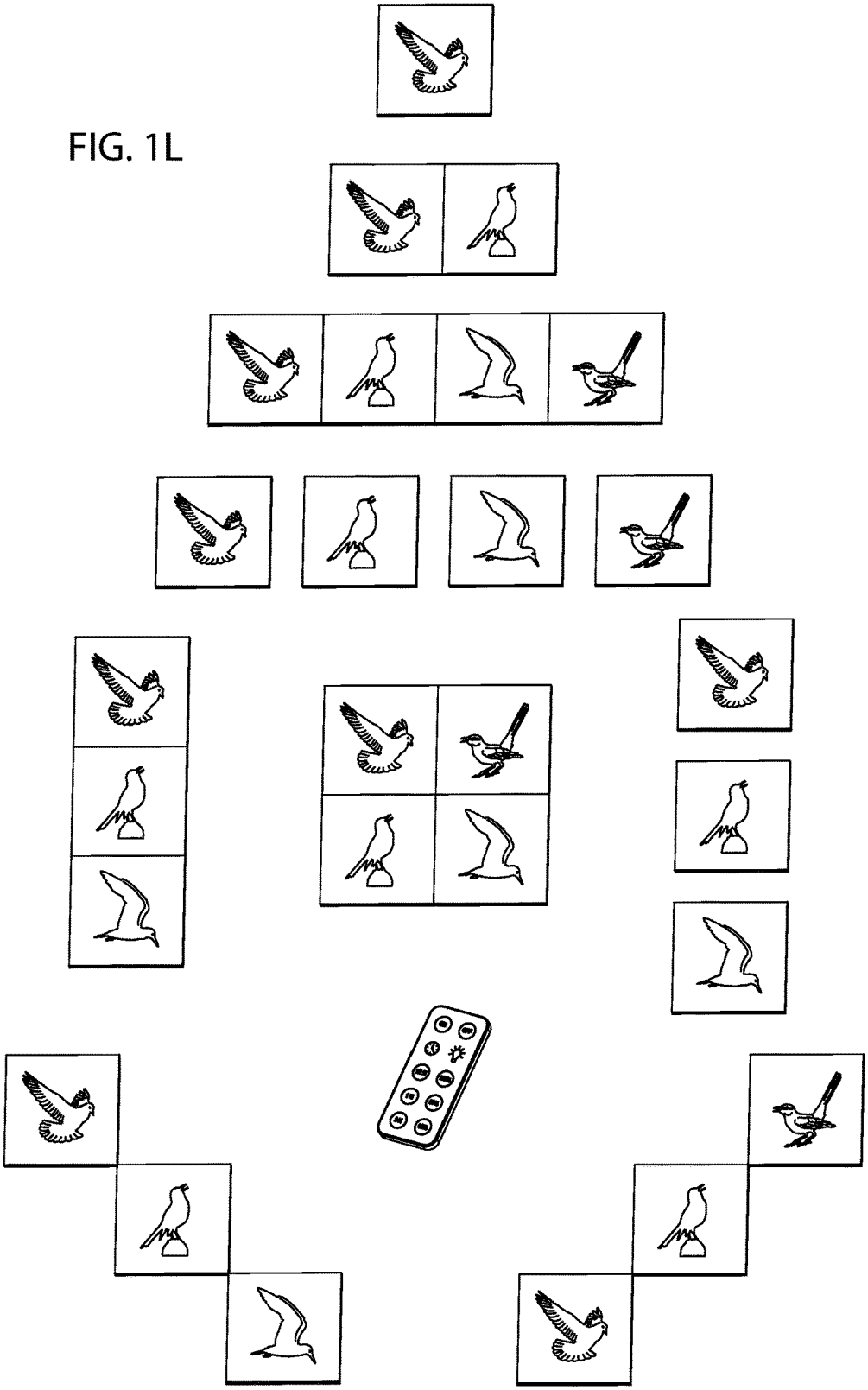
FIG. 1L is a top isometric view of 27 light tile assemblies, wherein various wall-mounting options are illustrated, and alongside the various mounting configurations is a wireless remote control.

In FIG. 1L, numerous light tiles 1 are shown from a top isometric view, wherein several mounting options are presented that include "tiled" and "non-tiled" formats as well as mounting options for horizontal, vertical, or diagonal groupings.

Figure 1M:
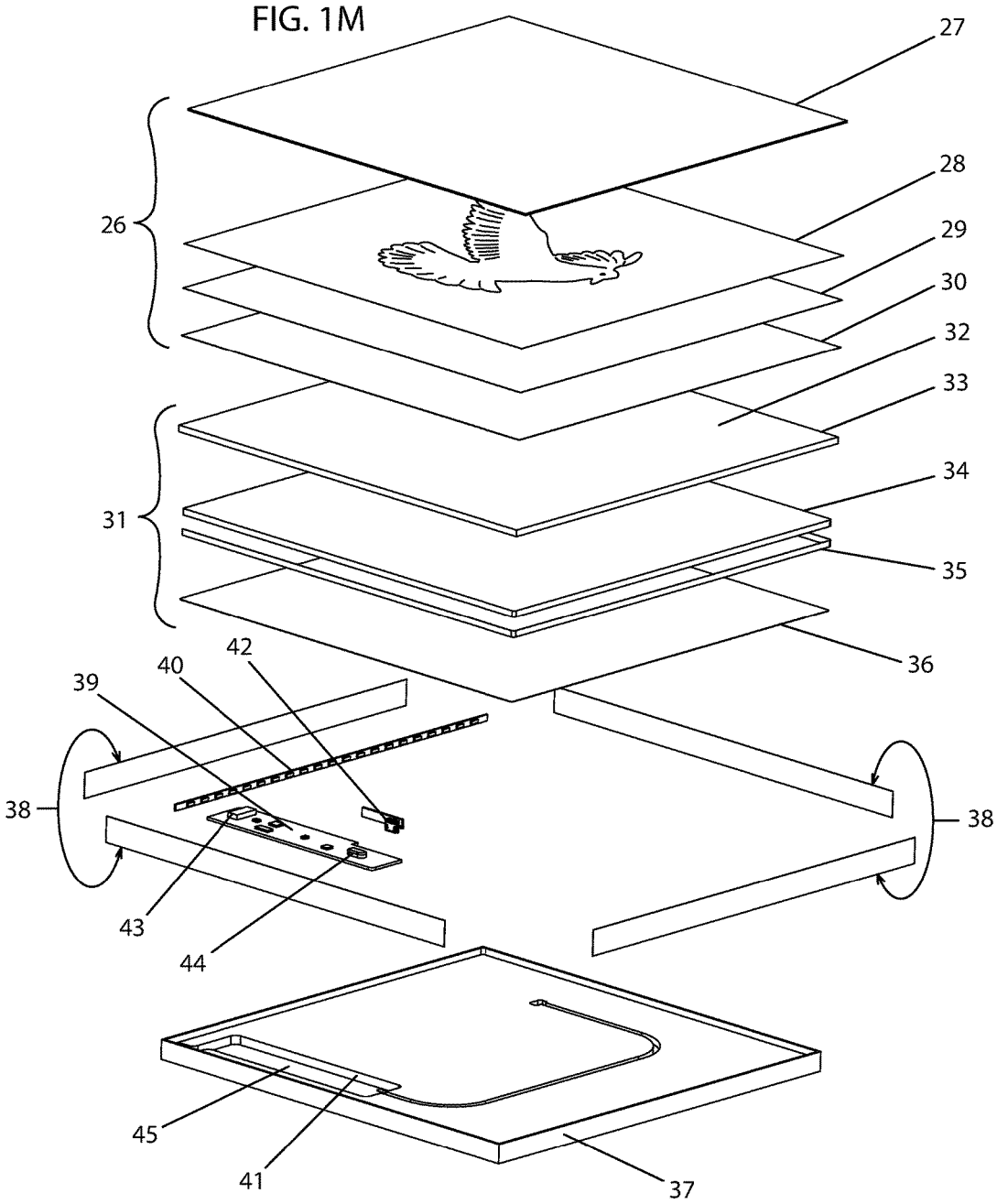
FIG. 1M is a top exploded view of the light tile assembly, wherein various layers and components of the assembly are clearly visible.

One of the big design challenges that arises when constructing a thin, edge-to-edge illuminated lighting configuration is how to avoid "hotspots" that occur along the linear edge where the LEDs shine into the light guide panel 34 (shown in FIG. 1M). The low-profile light tile 1 of the present invention, which is shown in the top exploded view in FIG. 1M, employs eight layers including two ink layers and one adhesive layer. The eight-layer construction can further be described as a multi-layer assembly that employs (from top to bottom—the top being the side that displays the photograph or artwork image) a top overlay sub-assembly 26 comprising four layers that include (from top to bottom), a semi-rigid transparent plastic cover sheet 27, a colored ink layer 28, an opaque-white ink layer 29 (that may include two or more layers of white that are printed in rapid succession and therefore bond together to form one layer), and a permanent/removable double-sided tape layer 30. Next is a mid-layer illumination sub-assembly 31 comprising three layers that include (from top to bottom), a thick (preferably 1/8 inch thick, but may be 1/16-3/16 inch thick) translucent, milky-white diffusion layer 33, a light guide panel 34 (which may include a light guide pattern along the edge that is adjacent to the LED strip, and may also include a light guide pattern on one or two sides of the panel), and a thin opaque-white reflective layer 36. And finally, at the bottom of the light tile assembly is a main body base structure/housing unit 37. It is worth noting that the top surface of the thick, translucent, milky-white layer 33 (which is part of the mid-layer illumination sub-assembly 31) may be frosted or have a sandblasted texture 32 to increase the diffusion properties that are employed by this layer, or the top surface may be frosted or have a sandblasted texture 32 to help reduce the surface tension between the top overlay adhesive layer 30 and the top surface of the milky-white diffusion layer 33 so that the top overlay sub-assembly 26 is easier to peel away from top surface of the light tile 1 when one photo or artwork image is being replaced by another photo or artwork image.

The light tile assembly 1 includes a main body 4 with four semi-rigid side walls 38 that define a volume. Additionally, there is a top overlay sub-assembly 26 adjacent to the top of the main body, and a mid-layer illumination sub-assembly 31 disposed of in the main body volume. The top overlay sub-assembly 26 includes a semi-rigid transparent plastic cover sheet 27, a colored ink layer 28, an opaque-white ink layer 29 that may be formed by one or more white ink layers that are bonded together to form one layer and a double-sided tape layer 30. The mid-layer illumination sub-assembly 31 includes a thick translucent milky-white diffusion layer 33, a light guide panel 34, a light blocking, internally reflective, material strip (that may be metal or foil) applied to at least two side edges of the light guide panel 35, a light emitting diode (LED) strip 40 adjacent to at least one side edge of the light guide panel 35, and a thin opaque reflective sheet 36 adjacent to the bottom of the light guide panel 35. The thick translucent milky-white diffusion layer 33 is preferably ⅛ inch thick, but may be 1/16-3/16 inch thick, and has a top and bottom; the thick translucent milky-white diffusion 33 layer extends to the semi-rigid side walls 38. The light guide panel 34 is adjacent to the bottom of thick translucent milky-white diffusion layer 33, the light guide panel 34 has a top and a bottom and four side edges and the light guide panel 34 extends to within ⅛ inch of the outer edge of the assembly. The double-sided tape layer 30 removably adheres to the top of the thick translucent milky-white diffusion layer 33.

Now that the layers of light tile assembly 1 have been described, it is possible to explain how they function and how "hotspots" can be eliminated while achieving edge-to-edge illumination in a low-profile embodiment. LED "hotspots" can be eliminated by combining the various layers of the assembly in a specific order or sequence. A "sandwich" of LED "hotspot" blocking layers is created by combining the opaque-white ink layer 29 from the top overlay sub-assembly 26, with the 1/16-3/16 inch-thick, translucent, milky-white diffusion layer 33 from the mid-layer illumination assembly 31. There is no need for a uniform air-gap between these layers to help diffuse the LED "hotspots," but instead, diffusion is achieved via the thicknesses of the 1/16-3/16 inch-thick, translucent, milky-white layer 33 and the opaque properties of the opaque-white ink layer 29. Instead of a uniform air-gap between these layers, there is an adhesive layer 30 that removably adheres them together. The colored ink layer 28 from the top overlay sub-assembly 26, and the optional frosted or sandblasted texture 32 that may be employed on the top surface of the thick, translucent, milky-white layer 33 may also contribute to diffusing or blocking the LED "hotspots."

Edge-to-edge illumination in a thin embodiment is a difficult design challenge that is addressed via the following solutions. First, seven of the eight layers of the low-profile light tile assembly 1 extend to within 0.0625 inches or less from the exterior surface of the sidewalls of the light tile assembly 1; and the eighth layer, which is the colored ink layer 28, may also extend to within 0.0625 inches or less from the exterior surface of the sidewalls. However, this is not required for the colored ink layer 28. Additionally, the bottommost layer of the light tile assembly 1, i.e., the main body base structure/housing unit 37, also employs ultra-thin light guide retaining walls 46 (see FIG. 1N) that do not extend inward more than 0.0625 inches from the exterior surface of the sidewalls of the embodiment. To be more specific, the top four layers of the top overlay sub-assembly 26 and the thick, translucent, milky-white diffusion layer 33 of the mid-layer illumination sub-assembly 31 extend to within 0.015 inches or less from the exterior surface of the sidewalls of the light tile assembly 1. Together, these top five layers cantilever over the exterior edges of the light guide panel 34 by not more than 0.125 inches. If these layers cantilever more than 0.125 inches, proper illumination will not reach the perimeter edges of the lighting assembly. The preferred cantilever overhang is approximately 0.0625 inches or less. And last, edge-to-edge illumination of the light tile assembly 1 is made possible by employing four ultra-thin, semi-rigid, sidewall concealing strips with a self-adhesive backing 38. One long concealing strip that folds at the corners of the sidewalls is also a viable configuration. Put more simply, light is able to travel to the edges of the assembly because the sidewalls of the light tile are extremely thin. Basically, the sidewalls of the light tile assembly are preferably formed by four simple, thin, semi-rigid strips 38 that adhere to the exterior sidewalls or edges of the main body base structure/housing unit 37 and the exterior edges of the thick, translucent, milky-white diffusion layer 33. Ultra-thin sidewalls 38 provide edge-to-edge illumination for the photograph or artwork overlay 2.

Getting back to the components of the light tile assembly 1 that are shown in FIG. 1M, the top surface of the thick, translucent, milky-white diffusion layer 33 may have a frosted or sandblasted texture 32 to increase the diffusion properties that are employed by this layer, or the top surface may be frosted or have a sandblasted texture 32 to help reduce the surface tension between the top overlay adhesive layer 30 and the top surface of the milky-white diffusion layer 33, so the top overlay sub-assembly 26 is easier to peel away from the top surface of the light tile 1 when one photograph or artwork image 2 is being replaced by another photograph or artwork image 2.

Also shown in FIG. 1M is a self-adhesive, light-blocking, internally reflective, material strip 35 (that may be metal or foil). The self-adhesive material strip 35 wraps around three of the outside edges of the light guide panel 34. The fourth edge that the self-adhesive material strip does not wrap around is the linear edge located adjacent to the LED light strip 40. The self-adhesive material strip 35 provides two services. First, it contains the light within the light guide panel 34, which concentrates the light toward the top surface of the light guide panel 34; and second, it blocks the light from shining out through the edges of the light guide panel 34 and through the ultra-thin, semi-rigid sidewall concealing strips 38 that form the sidewalls of light tile assembly 1. If light were to shine through the sidewalls of the assembly, this would be unsightly and decrease the aesthetic appeal of low-profile light tile 1.

Continuing on with the components shown in FIG. 1M, the main body base structure/housing unit 37 employs a PC board cavity 45 that is designed to contain a PC board 39, and a micro-size female USB receptacle mounting wall 41 may be employed for mounting a micro-size female USB receptacle 42. The micro-size female USB receptacle 42 is used to plug the light tile 1 into a standard wall socket when the light tile 1 is utilized as a countertop display. And finally, shown in FIG. 1M are: an LED light strip 40, an efficient LED driver circuit 43, and a wireless remote-control receiving tower 44. As mentioned earlier, when the size of light tile assembly 1 is increased to a large format display, the embodiment may employ one or more additional LED light strips 40. The efficient LED driver circuit 43 sends a signal to LED light strip 40, and the signal instructs the LED light strip 40 to conserve power. The wireless remote-control receiving tower 44 receives the wireless signal sent by the wireless remote control 5.

The light tile assembly 1 may also be activated by voice. To implement this feature, the PC board may have a microphone 64 (see FIG. 1N) connected to it, and the PC board 39 may include a processor for speech recognition and processing. Through verbal commands a user may instruct the light tile assembly 1 to turn on or off, or the user may command it to stay illuminated for a specified amount of time.

Figure 1N:
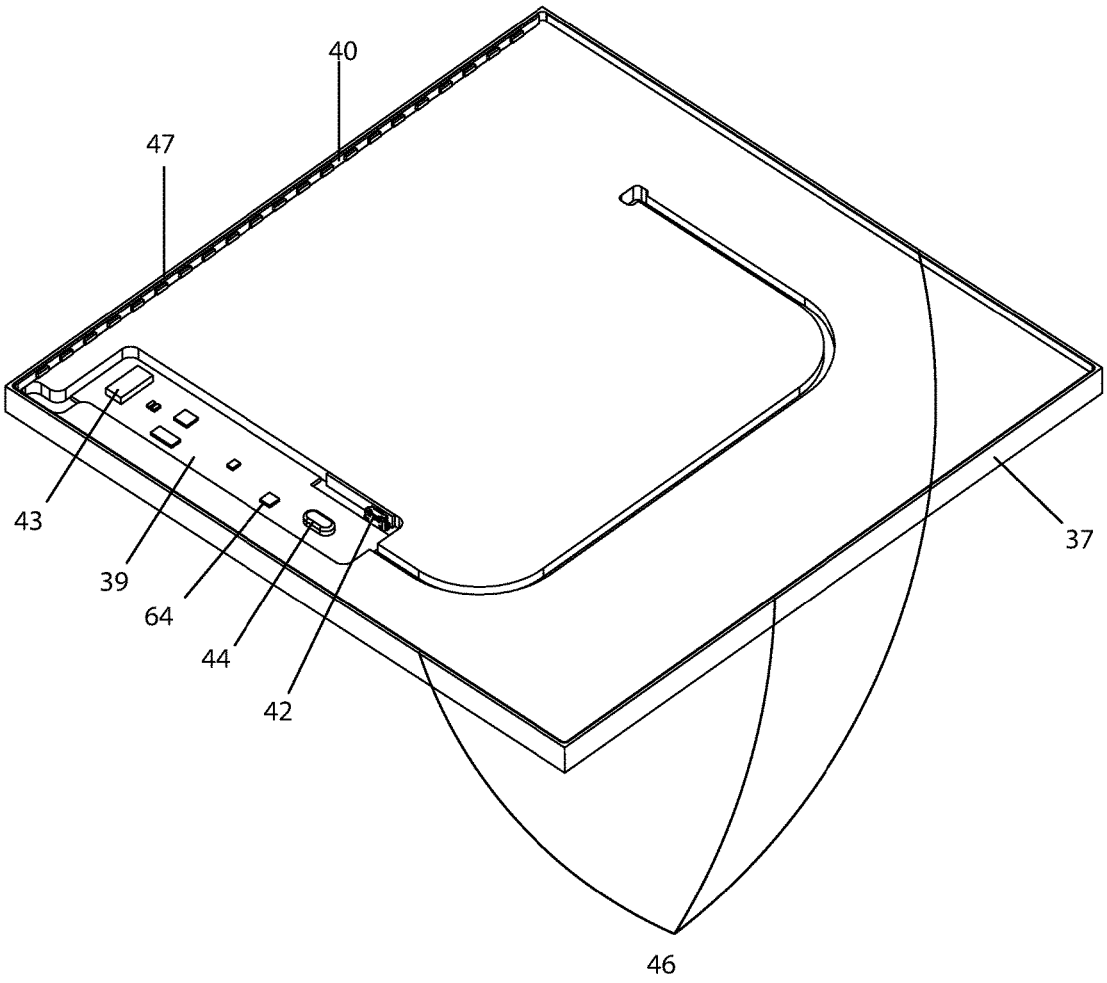
FIG. 1N is a top isometric view of the main body base structure/housing unit, wherein various structural features are highlighted.

FIG. 1N shows a top isometric view of the main body base structure/housing unit 37 that forms the bottom layer of the light tile assembly 1. This layer has been engineered in such a simple way that it can be CNC machined from a single piece of three-eighths-inch opaque-white acrylic sheet. Shown in FIG. 1N are three ultra-thin light guide retaining walls 46 that are configured to not extend inward more than 0.0625 inches from the exterior surface of the sidewalls of the embodiment. The ultra-thin light guide retaining walls 46 allow the light guide panel 34 to extend very close to the outside edges of the assembly so edge-to-edge illumination can be provided to the top overlay sub-assembly 26. FIG. 1N also shows an ultra-thin LED light strip mounting wall 47 that allows the LED light strip 40 to mount to the main body base structure/housing unit 37. The ultra-thin LED light strip mounting wall 47 is optional because the LED light strip could be mounted to the linear edge of the light guide panel 34; however, the electrical wiring options are simpler when the LED strip 40 is mounted to the ultra-thin LED light strip mounting wall 47. The other components shown in FIG. 1N have already been discussed.

Figures 1O, 1P:
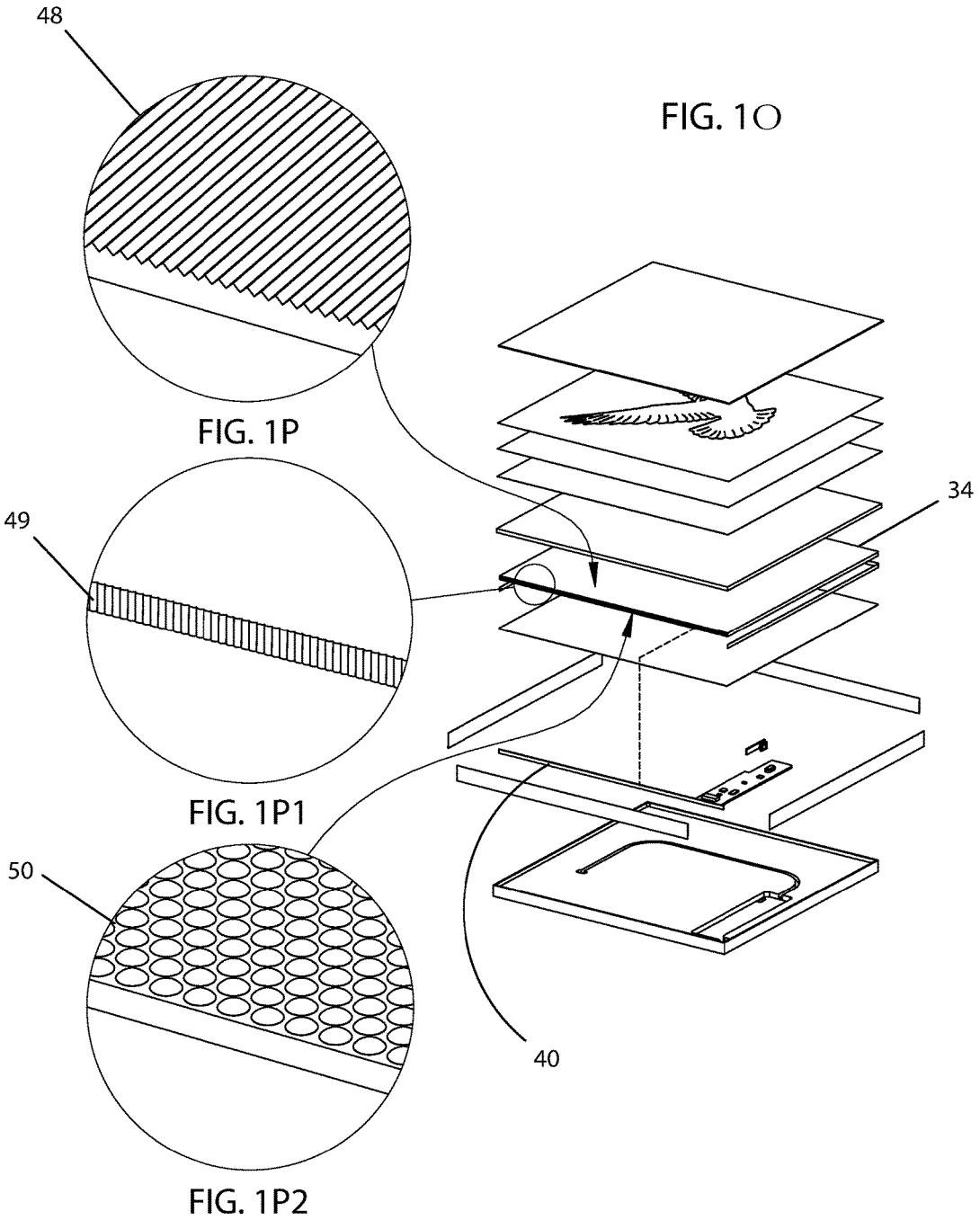
FIG. 1O is a top exploded view of the light tile assembly, wherein various features of the light guide panel are shown in greater detail.
FIG. 1P is a top enlarged view of a portion of the top surface of the light guide panel.

FIG. 1O presents a top exploded view of the light tile assembly 1 wherein a portion of the top surface, bottom surface, and linear edge of the light guide panel 34 has been enlarged to help further explain the construction of the light guide panel 34. More specifically, FIG. 1P shows an enlarged portion of the top surface of the light guide panel 34, wherein a top surface light guide pattern 48 is employed to spread light within the panel 34, while also increasing the uniformity and brightness of the illuminated panel. The light guide pattern on the top, bottom, and edge of the light guide panel 34 may be configured as dot patterns, micro-prisms, micro-grooves, micro-dots, v-groove structures, or other structures. The light guide patterns on the top, bottom, or edge of the light guide panel 34 may be printed, hot-embossed, silk screened, molded, or etched, depending on the manufacturer who supplies the light guide panel 34. The light guide pattern on light guide panel 34 may be employed on either the top or bottom surface, or both surfaces, and the light guide pattern on the edge can be employed alone or in conjunction with either the top or bottom light guide patterns. FIG. 1P1 shows an enlarged portion of the linear-edge light guide pattern 49, and FIG. 1P2 shows an enlarged portion of the bottom-surface light guide pattern 50. Both the linear-edge light guide pattern 49, and the bottom-surface light guide pattern 50 are employed to spread light within the light guide panel 34, while also increasing the uniformity and brightness of the illuminated panel.

Figure 1Q:
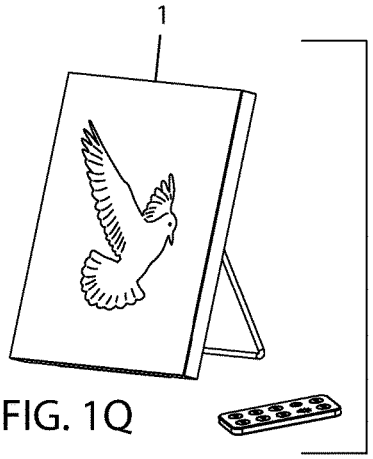
FIG. 1Q is a top isometric view of the light tile assembly, wherein the light tile is shown mounted to the folding countertop display stand.

The light tile assembly 1 may be mounted to a wall, or it may be utilized as a countertop display as illustrated in FIG. 1Q, which shows the light tile 1 mounted to a folding countertop display stand 51. FIG. 1Q1 shows a back isometric view of the light tile, wherein the light tile 1 is mounted to a folding display stand 51; and FIG. 1Q2 shows a side view of the light tile 1, wherein the light tile is mounted to a folding display stand 51.

When the light tile 1 is used as a countertop display, the light tile uses an almost identical male/female magnet-based mounting system, except, instead of using self-releasing foam strips 33 (FIGS. 1H-1I), the male plug sub-assembly 52 that attaches to the folding countertop display stand 51 uses a permanent adhesive layer 54 so the male plug sub-assembly 52 stays permanently attached to the countertop display stand 52. So when the light tile 1 is used as a countertop display, it mounts to the countertop display stand 51 in a similar way to how the light tile 1 mounts to a wall.

Figure 1R:
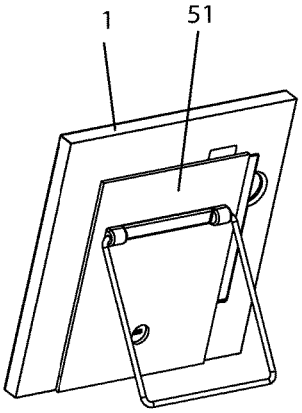
FIG. 1R is a top exploded view of the folding countertop display stand, wherein the male plug sub-assembly is highlighted.
Figure 1R:
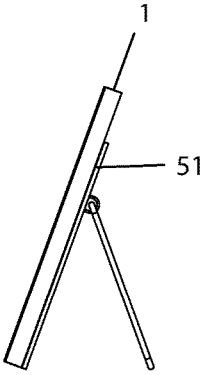
Figure 1R:
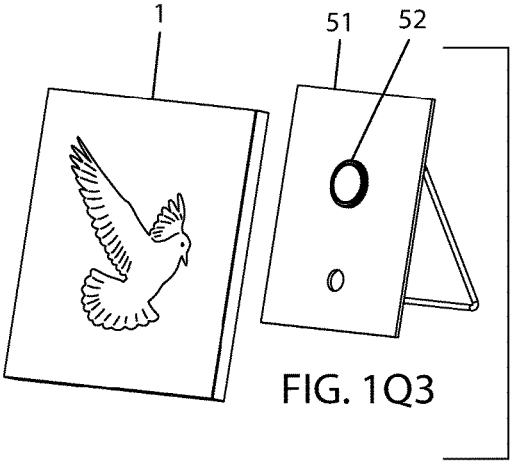
Figure 1R:
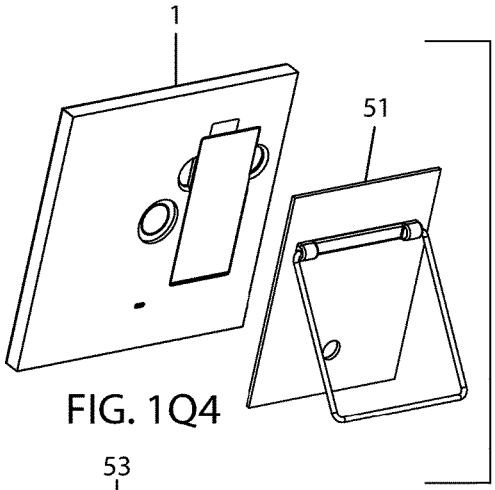
Figure 1R:
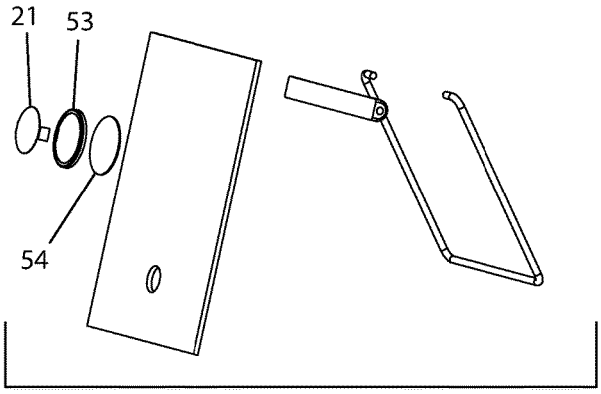
Figure 1S:
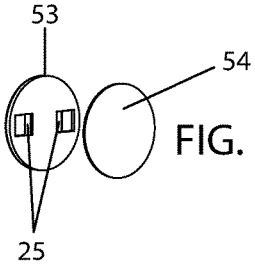
FIG. 1S is a side view of four folding countertop display stands, wherein the stands stack neatly on top of one another.
Figure 1S:
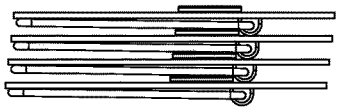

FIG. 1Q3 presents a top exploded view of the light tile 1 and the folding countertop display stand 51, where the male plug sub-assembly 52 is shown permanently mounted to the folding display stand 51. A back exploded view of the assembly is shown in FIG. 1Q4, where the female wall mount recess 8, which mates with the male plug assembly 52, can be clearly seen in the center of the back wall of the embodiment. FIG. 1R shows a top exploded view of the display stand where the exploded parts of male plug sub-assembly 52 can be seen more clearly and include: a metal disk with crimp tabs 21, a male plug 53, and a permanent adhesive layer 54. The metal disk 21 mounts to the top of the male plug 53, and the male plug 53 permanently adheres to the folding countertop display stand 51. The male plug sub-assembly is also shown from a back exploded view in FIG. 1R1. The folding countertop display stands 51 stack neatly on top of one another as shown in the side-view illustration, which is presented in FIG. 1S.

When the light tile is utilized as a countertop display, it can simply use a standard USB cord assembly 55 to plug into a standard wall socket as shown in FIGS. 1T-1T2. The standard USB cord assembly 55 comprises a standard-size male USB plug 56, a USB transformer plug 63, and a micro-size male USB plug 57. The standard-size male USB plug 56 inserts into the USB transformer plug 63. The back plate for the folding display stand 51 may be simply cut from an acrylic sheet; however, for the USB cord to pass through the acrylic sheet, and for the micro-size male USB plug 57 to plug into the micro-size female USB receptacle 42, a through hole 58 must be cut through the acrylic sheet (clearly illustrated in FIG. 1T2).

Figure 1U:
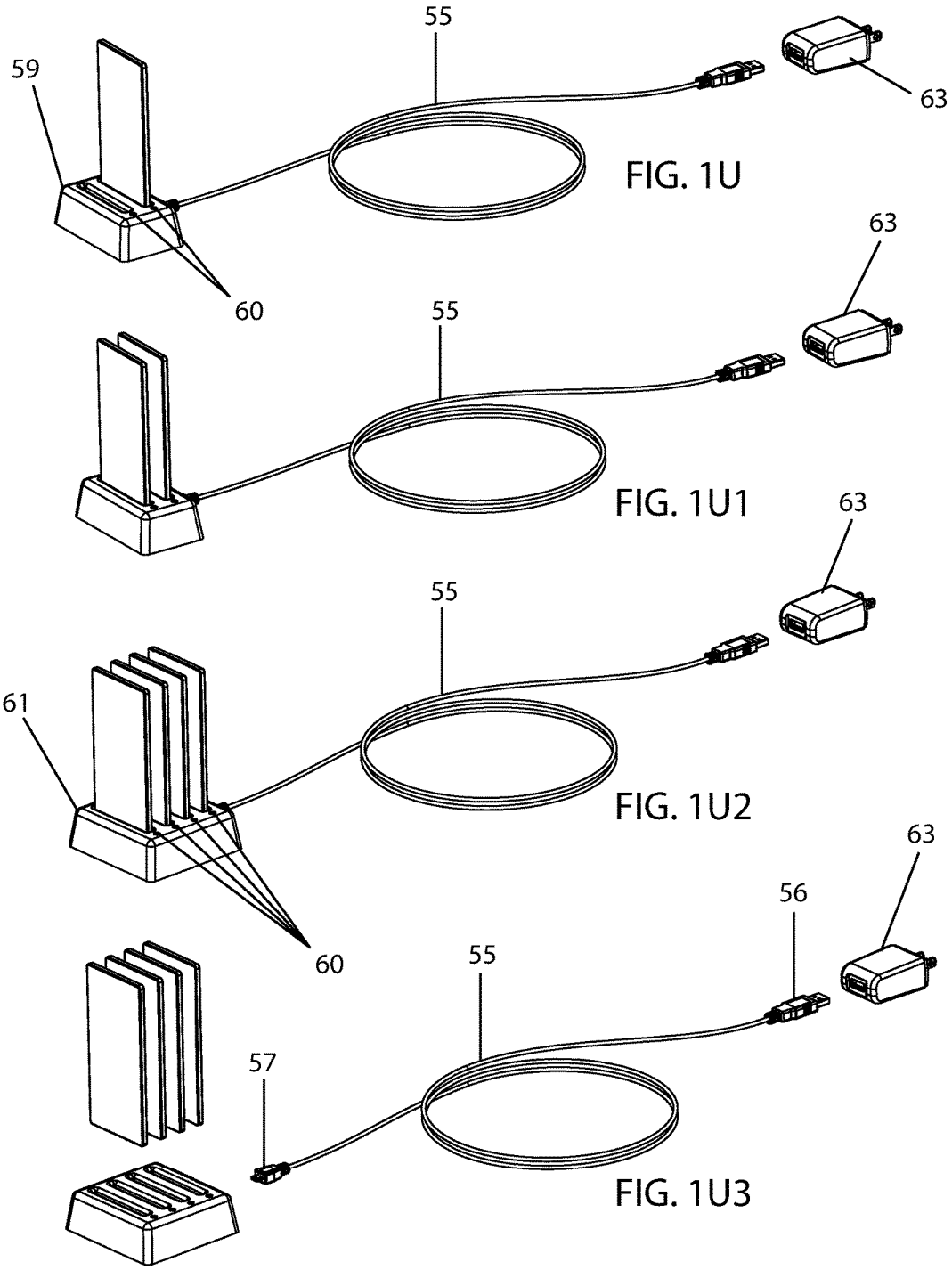
FIG. 1U is a top isometric view of a two-port battery charging station, shown charging one battery, wherein the charging station features full charge indicator lights, and also shown is a standard USB cord assembly.

When the consumer purchases a light tile assembly 1, it may come in a light tile kit that contains other components that support the use of the light tile 1. One such component as shown in FIGS. 1U-1U3 is a battery charging station that includes full indicator lights 60, which alert the consumer when the ultra-thin battery 6 has received a full charge. The battery charging station may, for example, be constructed as a two-port battery charging station 59 as illustrated in FIG. 1U and FIG. 1U1, or it may be constructed as a four-port battery charging station 61 as illustrated in FIG. 1U2 and FIG. 1U3. The full-charge indicator lights 60 are clearly presented in FIGS. 1U-1U3. Both the two-port battery charging station 59, and four-port battery charging station 61 may plug into a standard wall socket by employing the same standard USB cord assembly 55 that is used by the light tile assembly 1, when the assembly is utilized as countertop display. Also, to conserve desktop space, the ultra-thin rechargeable battery 6 is configured as a narrow rectangle cube with a depth, width, and length. The dimension of the width or length is at least ten times that of the depth, the dimension of the length is at least two times that of the width, and the depth and width define a battery charging surface. The two-port or four-port battery charging station 59, 61, include a base defining a plane and a top, the top having a plurality of closely grouped charging ports, each port sized to accommodate the battery charging surface; wherein when the battery is inserted into the battery charging port, the length dimension of the battery is substantially orthogonal to the base plane.

As mentioned earlier, the light tile assembly 1 may come in a kit that contains other components that support the use of the light tile 1. FIGS. 1V-1V3 show that the light tile 1 may come in various kit configurations. FIG. 1V shows a single-unit kit that does not include a battery, wherein the light tile 1 is utilized as a countertop display. FIG. 1V1 shows a single-unit kit that does include a battery, and the light tile may be used as a wall mount or countertop display. FIG. 1V2 shows a two-unit kit that provides components for both wall mount and countertop applications. FIG. 1V3 shows a four-unit kit that provides components for four wall mount applications and two countertop applications.

Although in some of the earlier discussions about the construction of the light tile assembly 1, the light tile was described as having frameless edge-to-edge illumination, the term "frameless" was used to describe the edge-to-edge illumination component of the light tile 1, and the light tile 1 may actually employ a frame, as shown in FIGS. 1W-1W5. FIG. 1W shows a top isometric view of a front-surface-mounting picture frame 62 mounted to the front of the light tile assembly 1. FIG. 1W1 shows a back isometric view of the light tile assembly 1, wherein the light tile is inserted into a back opening of the picture frame 62. FIG. 1W2 shows a top exploded view of the front-surface-mounting picture frame 62, wherein the picture frame 62 is elevated above the light tile assembly 1. FIG. 1W3 shows a back exploded view of the front-surface-mounting picture frame 62, wherein the light tile assembly 1 is elevated above the picture frame 62. And FIGS. 1W4 and 1W5 show a back view and back exploded view of the front-mounting picture frame 62 wherein the picture frame 62 is mounted to the front surface of the light tile assembly 1. The male/female magnet-based mounting system works the same with or without the picture frame 62 mounted to the light tile assembly 1.

The invention has been described in connection with specific embodiments that illustrate examples of the invention but do not limit its scope. Unless indicated otherwise, any feature, aspect or element of any of these example embodiments may be removed from, added to, combined with or modified by any other feature, aspect or element. As will be apparent to persons skilled in the art, modifications and adaptations to be above-described example embodiments of the invention can be made without departing from the spirit and scope of the invention, which is defined only by the following claims.

The invention claimed is:

1. A light tile assembly comprising:

a light tile main body with four semi-rigid side walls, wherein the main body and side walls define a volume and an outer edge;

a top overlay sub-assembly adjacent to the top of the main body, and a mid-layer illumination sub-assembly disposed of in the volume;

the top overlay sub-assembly comprising:

a semi-rigid transparent plastic cover sheet;

a colored ink layer;

an opaque-white ink layer that may be formed by one or more white ink layers that are bonded together to form one layer;

a double-sided tape layer;

the mid-layer illumination sub-assembly comprising:

a thick translucent milky-white diffusion layer that is 1/16-3/16 inch thick and has a top and bottom, the thick translucent milky-white diffusion layer extending to the semi-rigid side walls;

a light guide panel adjacent to the bottom of thick translucent milky-white diffusion layer, the light guide panel having a top and a bottom and first, second, third and fourth side edges wherein the light guide panel extends to within 1/8 inch of the outer edge;

a light blocking, internally reflective, material applied to at least two side edges of the light guide panel;

a light emitting diode (LED) strip adjacent to at least one side edge of the light guide panel;

a thin opaque reflective sheet adjacent to the bottom of the light guide panel;

wherein the double-sided tape layer is removably adhered to the top of the thick translucent milky-white diffusion layer; and a main body base structure adjacent to the bottom of the thin opaque reflective sheet.

2. The light tile assembly of claim 1, wherein an outside surface of the main body base structure comprises a recessed battery cavity and a battery disposed of in the recessed battery cavity; and the main body base structure further comprises:

a printed circuit board (PCB) cavity; and a PCB connected to the battery and the LED strip, wherein the PCB is disposed of in the PCB cavity.

3. The light tile assembly of claim 2, wherein the recessed battery cavity comprises a magnet, and the battery is magnetically attracted to the magnet.

4. The light tile assembly of claim 2, wherein the battery is flush with, or does not extend away from more than 3/32 inch from the outside surface of the main body base.

5. The light tile assembly of claim 2, wherein the recessed battery cavity comprises finger-grab cutouts.

6. The light tile assembly of claim 2, wherein the main body base structure includes a USB receptacle, and the USB receptacle is accessible from the outside surface of the light tile main body.

7. The light tile assembly of claim 6, wherein the USB receptacle is connected to a power source, and the power source provides power to the LED strip.

8. The light tile assembly of claim 2, wherein the PCB comprises an efficient LED driver circuit.

9. The light tile assembly of claim 2, wherein the battery is rechargeable.

10. The light tile of claim 2, the light tile assembly further comprising a microphone connected to the PCB, wherein the PCB further comprises a speech processor constructed to illuminate the LED strip in response to verbal commands received by the microphone, wherein the response may include illuminating the LED strip for a specified period of time.

11. The light tile of claim 1, wherein the light tile main body base structure comprises a micro-size female USB receptacle mounting wall.

12. The light tile of claim 2, wherein the recessed battery cavity comprises a compression foam strip or metal spring clip(s).

13. The light tile assembly of claim 1, wherein the main body base structure comprises light guide panel retaining walls that contain the light guide panel on at least two sides.

14. The light tile assembly of claim 1 wherein the main body base structure comprises a LED light strip mounting wall.

15. The light tile assembly of claim 1, further comprising a front-surface-mounting picture frame.

16. The light tile assembly of claim 1, further comprising a printed circuit board with a wireless remote-control receiver, wherein the LED strip is controlled by a wireless remote control.

17. The light tile assembly of claim 1, further comprising a release liner adhered to the bottom of the double-sided tape layer; wherein the release liner is removed prior to adhering the top overlay sub-assembly to the top of the thick translucent milky-white diffusion layer.

18. The light tile assembly of claim 1, wherein the top surface of the thick translucent milky-white diffusion layer comprises a frosted or sandblasted texture that extends to the semi-rigid side walls.

19. The light tile assembly of claim 1, wherein the colored ink layer is printed in reverse on the backside of a semi-rigid transparent plastic cover sheet, and an opaque-white ink layer is printed behind the colored inks.

20. The light tile assembly of claim 1, wherein the top surface, bottom surface, or linear edge adjacent to the LED strip comprises a light guide pattern.

21. The light tile assembly of claim 1, wherein an outside surface of the main body base structure comprises a female wall mount recess, a magnet is disposed of in the female wall mount recess, the light tile assembly further comprising:

a male wall mount plug sub-assembly comprising a ferromagnetic material, the male plug sub-assembly constructed to magnetically couple to the magnet, the male plug sub-assembly having a back surface;

a self-releasing double-sided adhesive foam strips applied to the back surface of the male plug sub-assembly.

22. The light tile assembly of claim 21, further comprising a surface tension layer disposed of between the magnet and the ferromagnetic material.

23. The light tile assembly of claim 1, wherein an outside surface of the main body base structure comprises a female wall mount recess, a magnet is disposed of in the female wall mount recess, the light tile assembly further comprising:

a male plug sub-assembly comprising a ferromagnetic material layer, the male plug constructed to magnetically couple to the magnet, the male plug having a back surface;

a folding countertop stand connected to the back surface of the male plug sub-assembly.

24. The light tile assembly of claim 23, further comprising:

a main body base structure comprising a USB receptacle, and the USB receptacle is accessible from the outside surface of the main body;

the display stand further comprising a through hole that aligns with the USB receptacle when the male plug is magnetically coupled to the magnet.

25. A light tile kit, comprising:

a light tile assembly comprising:

a light tile main body with four semi-rigid side walls, wherein the main body and side walls define a volume and an outer edge;

a top overlay sub-assembly adjacent to the top of the main body, and a mid-layer illumination sub-assembly disposed of in the volume;

the top overlay sub-assembly comprising:

a semi-rigid transparent plastic cover sheet;

a colored ink layer;

an opaque-white ink layer that may be formed by one or more white ink layers that are bonded together to form one layer;

a double-sided tape layer;

the mid-layer illumination sub-assembly comprising:

a thick translucent milky-white diffusion layer that is 1/16-3/16 inch thick and has a top and bottom, the thick translucent milky-white diffusion layer extending to the semi-rigid side walls;

a light guide panel adjacent to the bottom of thick translucent milky-white diffusion layer, the light guide panel having a top and a bottom and first, second, third and fourth sides wherein the light guide panel extends to within 1/8 inch of the outer edge;

a light blocking, internally reflective, material applied to at least two side edges of the light guide panel;

a light emitting diode (LED) strip adjacent to at least one side edge of the light guide panel;

a thin opaque reflective sheet adjacent to the bottom of the light guide panel;

wherein the double-sided tape layer is removably adhered to the top of the thick translucent milky-white diffusion layer;

a main body base structure is adjacent to the bottom of the thin opaque reflective sheet;

wherein an outside surface of the main body base structure comprises a recessed battery cavity;

and disposed in the cavity is a rechargeable and removable battery;

wherein the battery is substantially a rectangular cube with a depth, width, and length;

wherein the dimension of the width or length is at least ten times that of the depth;

wherein the dimension of the length is at least two times that of the width; and wherein the depth and width define a battery charging surface;

a battery charging station with a base defining a plane and a top, the top having plurality of closely grouped charging ports, each port sized to accommodate the battery charging surface, wherein when the battery is inserted into the charging port, the length dimension of the battery is substantially orthogonal to the base plane.

26. The light tile kit of claim 25 wherein the battery charging station comprises a USB receptacle, the kit further comprising a USB transformer plug, and a USB cord configured to plug into the USB receptacle and the USB transformer plug.

27. The light tile kit of claim 26, the light tile assembly further comprising a main body base structure comprising a second USB receptacle, and the second USB receptacle is accessible from the outside surface of the main body base structure; wherein the USB cord is configured to plug into the second USB receptacle and the USB transformer plug.

* * * * *